US011396082B2

(12) United States Patent
Nishida

(10) Patent No.: US 11,396,082 B2
(45) Date of Patent: Jul. 26, 2022

(54) SUBSTRATE HOLDING DEVICE AND SUBSTRATE PROCESSING APPARATUS INCLUDING THE SAME

(71) Applicant: Ebara Corporation, Tokyo (JP)

(72) Inventor: Hiroaki Nishida, Tokyo (JP)

(73) Assignee: Ebara Corporation, Tokyo (JP)

( * ) Notice: Subject to any disclaimer, the term of this patent is extended or adjusted under 35 U.S.C. 154(b) by 927 days.

(21) Appl. No.: 16/186,767

(22) Filed: Nov. 12, 2018

(65) Prior Publication Data

US 2019/0143479 A1 May 16, 2019

(30) Foreign Application Priority Data

Nov. 13, 2017 (JP) ..... JP2017-218564

(51) Int. Cl.
*B24B 37/30* (2012.01)
*B24B 37/10* (2012.01)

(52) U.S. Cl.
CPC ..... *B24B 37/30* (2013.01); *B24B 37/107* (2013.01)

(58) Field of Classification Search
CPC ..... B24B 37/30; B24B 37/107; H01L 21/683; H01L 21/68; H01L 21/68714; H01L 21/68742; H01L 21/68728; B23Q 3/18–186
USPC ..... 451/246
See application file for complete search history.

(56) References Cited

U.S. PATENT DOCUMENTS 6,761,362 B2 * 7/2004 Noguchi ..... H01L 21/67288 118/503
6,827,092 B1 * 12/2004 Smith ..... H01L 21/68728 134/147
7,499,767 B2 * 3/2009 Kurita ..... H01L 21/67265 700/218
7,999,242 B2 * 8/2011 Zama ..... G01N 21/9506 250/559.14
2002/0000371 A1 1/2002 Mishima et al.
2002/0046810 A1 * 4/2002 Tanaka ..... H01L 21/68728 156/345.51

(Continued)

FOREIGN PATENT DOCUMENTS

JP H08-274060 A 10/1996
JP 2001-342597 A 12/2001

(Continued)

*Primary Examiner* — Tyrone V Hall, Jr.
*Assistant Examiner* — Jason Khalil Hawkins
(74) *Attorney, Agent, or Firm* — Leydig, Voit & Mayer, Ltd.

(57) ABSTRACT

There is provided a device and method for accurately positioning a substrate on a stage by a simple method using power of a movement mechanism provided for a movable stage. A substrate holding device for holding a substrate is provided. The substrate holding device includes a substrate stage for supporting the substrate, a stage drive mechanism for causing the substrate stage to move, positioning pin for positioning the substrate on the substrate stage, first urging members each urging the positioning pin, and a stopper member capable of applying a force against the urging member to the positioning pin. The positioning pin is configured to move together with the substrate stage by the stage drive mechanism. The positioning pin moving together with the substrate stage allows the substrate to be positioned on the substrate stage.

14 Claims, 18 Drawing Sheets

(56) References Cited

U.S. PATENT DOCUMENTS

| | | | | |
|---|---|---|---|---|
| 2006/0011300 | A1* | 1/2006 | Kim | H01L 21/68728 156/345.51 |
| 2006/0027323 | A1* | 2/2006 | Miya | H01L 21/68778 156/345.23 |
| 2013/0320636 | A1* | 12/2013 | Ogawa | H01L 21/68728 279/110 |
| 2014/0299166 | A1* | 10/2014 | Furuya | H01L 21/68728 134/153 |
| 2014/0373289 | A1* | 12/2014 | Miyazaki | H01L 21/67046 15/21.1 |
| 2017/0162409 | A1 | 6/2017 | Toyomura et al. | |

FOREIGN PATENT DOCUMENTS

| | | | |
|---|---|---|---|
| JP | 2003-133275 | A | 5/2003 |
| JP | 2013-065658 | A | 4/2013 |

* cited by examiner

SUBSTRATE HOLDING DEVICE AND SUBSTRATE PROCESSING APPARATUS INCLUDING THE SAME

CROSS-REFERENCE TO RELATED APPLICATION

This application is based upon and claims the benefit of priority of the prior Japanese Patent Application No. 2017-218564, filed on Nov. 13, 2017, the entire contents of which are incorporated herein by reference.

TECHNICAL FIELD

The present invention relates to a substrate holding device and a substrate processing apparatus including the substrate holding device.

BACKGROUND

In a semiconductor manufacturing apparatus, when some kind of processing (chemical or mechanical processing, measurement, or the like) is performed on a pattern surface of a substrate Wf which is a process target object, the substrate Wf may be fixed onto a stage, a pedestal, or the like of a mechanism to process the substrate Wf. At this time, fixing any substrate Wf onto the same position on the stage without deviation makes possible similar processing on any substrate Wf and uniform quality in the final product. The precision requirement in each step in semiconductor device manufacturing by a semiconductor manufacturing apparatus these days has already reached a level of several nanometers, and to perform accurate processing on accurate positions on the substrate Wf, it is important to accurately position the substrate Wf.

There is a method of performing positional alignment between the substrate Wf and the stage with a center of the stage as a reference so that a center of the substrate Wf coincides with the center of the stage. The term "center of the stage" refers to a center of a circle in a case where the stage has a circular shape, or even if the stage does not have a circular shape, a center of rotation of the stage or a center of a holding portion provided outside the stage may be regarded as a "center of the stage" which is a reference for the positional alignment.

For example, PTL 1 discloses a method in which a plurality of alignment pins provided around the outer periphery of the substrate Wf are driven to move the substrate Wf toward the center of the stage, so that the center of the substrate Wf coincides with the center of the stage. Furthermore, PTL 2 discloses a method in which guides with a slope to lower in level toward the center of the stage are provided around the outer periphery of the substrate Wf so that the substrate Wf slides over the slope under gravity, whereby the center of the substrate Wf coincides with the center of the stage. There is also a method of positioning the substrate Wf on the stage by pressing the substrate Wf against a plurality of pins that are disposed at predetermined positions on the outer periphery of the stage.

In a semiconductor manufacturing process, a CMP (chemical mechanical polishing) apparatus may be used to polish the substrate Wf. The CMP apparatus includes a polishing unit for polishing a process target object, a cleaning unit for cleaning and drying the process target object, a loading/unloading unit that transfers the process target object to the polishing unit and receives the process target object having been cleaned and dried by the cleaning unit, and other units. The CMP apparatus further includes a transport mechanism that transports the process target object in each of the polishing unit, the cleaning unit, and the loading/unloading unit. The CMP apparatus sequentially performs the polishing, cleaning, and drying with the process target object transported by the transport mechanism.

The precision requirement in each step in semiconductor device manufacturing these days has already reached a level of several nanometers, and CMP is no exception. To satisfy the requirement, polishing and cleaning conditions are optimized in CMP. Even when optimum conditions are determined, however, there are inevitable changes in polishing and cleaning performance due to variations in component control and changes in consumable materials over time. Furthermore, there is also a variation in a semiconductor substrate itself, which is the process target object. There are, for example, pre-CMP variations in the thickness of a film formed on the process target object and in the shape of a device. Depending on the processing condition in the CMP process and the state of the layer below the film to be polished, the local on-substrate polishing amount distribution varies in some cases. Therefore, these variations manifest themselves in the form of a variation in residual film and incomplete step elimination during CMP and after CMP and further in the form of a remaining film in polishing of a film that should be completely removed in the first place. To address such a variation in local polishing amount, after the CMP process on the whole surface of the substrate, the local residual film on the substrate is polished and removed using a partial polisher which uses a polishing pad smaller in size than the substrate. In such a partial polisher, to polish the local protruding portion on the substrate, it is necessary to accurately press the polishing pad that is smaller in size against the protruding portion on the substrate. To do so, it is important to accurately position the substrate on the stage.

CITATION LIST

Patent Literature

PTL 1: Japanese Patent Laid-Open No. 2003-133275
PTL 2: Japanese Patent Laid-Open No. 2013-65658

SUMMARY

The method in which the plurality of alignment pins are driven to move the substrate Wf so that the center of the substrate Wf coincides with the center of the stage as disclosed in PTL 1 requires a motive power for driving the alignment pins. Therefore, an installation location of a motive power source such as a motor, and a space for a controller and wiring of the power source are required, which makes the device larger. When a positioning mechanism is incorporated in the existing substrate processing apparatus, or the like, it may be difficult to secure a space for the power source. Furthermore, if the motive power source or the like for positioning the substrate Wf is added, the cost is accordingly increased.

The method in which guides with a slope to lower in level toward the center of the stage are provided around the outer periphery of the substrate Wf so that the substrate Wf slides over the slope under gravity, whereby the center of the substrate Wf coincides with the center of the stage, as disclosed in PTL 2 causes a problem such as operational reliability. If a sliding surface between the substrate Wf and the guides has some abnormality (e.g., scratches, stains, or other defects), the substrate Wf does not slide over the slope as assumed and is caught on the slope, which makes it impossible to perform the positional alignment.

As for the method of positioning the substrate Wf on the stage by pressing the substrate Wf against a plurality of pins that are disposed at predetermined positions on the outer periphery of the stage, the center of the substrate Wf may deviate from the center of the stage due to a manufacturing error of the substrate. For example, a semiconductor substrate having 300 mm in diameter has a manufacturing error of about ±0.2 mm. When the substrate Wf is pressed from one side against the plurality of pins, the center of the substrate Wf may deviate from the center of the stage by the error of the substrate Wf.

An object of the present application is to provide a device and method for accurately positioning a substrate on a stage by a simple method using power of a movement mechanism provided for a movable stage.

[First Form] According to a first form, a substrate holding device for holding a substrate is provided. The substrate holding device includes a substrate stage for supporting the substrate, a stage drive mechanism for causing the substrate stage to move, a positioning pin for positioning the substrate on the substrate stage, first urging members each urging the positioning pin, and a stopper member capable of applying a force against the urging member to the positioning pin. The positioning pin is configured to move together with the substrate stage by the stage drive mechanism. The positioning pins moving together with the substrate stage allows the substrate to be positioned on the substrate stage.

[Second Form] According to a second form, the substrate holding device according to the first form further includes a base member whose position is fixed. The stopper member is fixed to the base member.

[Third Form] According to a third form, the substrate holding device according to the first or second form further includes a positioning pin stage. The positioning pin is fixed to the positioning pin stage, and the positioning pin stage is configured to be capable of engaging with and disengaging from the substrate stage.

[Fourth Form] According to a fourth form, in the substrate holding device according to the third form, the positioning pin stage is configured to be movable between (1) an engagement position at which the positioning pin stage engages with the substrate stage and (2) a disengagement position at which the positioning pin stage disengages from the substrate stage, the engagement position and the disengagement position being separate from each other in a direction perpendicular to a top surface of the substrate stage.

[Fifth Form] According to a fifth form, in the substrate holding device according to the fourth form, the positioning pin includes a substrate support portion, and when the positioning pin stage is at the disengagement position, the positioning pin is configured to be capable of supporting the substrate by the substrate support portion.

[Sixth Form] According to a sixth form, in the substrate holding device according to any one of the third to fifth form having a feature of the second form, the positioning pin stage is connected to the base member through a second urging member, and the second urging member is configured to urge the positioning pin stage in a direction opposite to a direction in which the positioning pin stage moves together with the substrate stage.

[Seventh Form] According to a seventh form, in the substrate holding device according to any one of the first to sixth form, the positioning pin is urged by the first urging member in a central direction of the substrate.

[Eighth Form] According to an eighth form, in the substrate holding device according to any one of the first to seventh form, the number of the positioning pins is three or more.

[Ninth Form] According to a ninth form, in the substrate holding device according to the eighth form, the number of the positioning pins is six or more.

[Tenth Form] According to a tenth form, in the substrate holding device according to any one of the first to ninth form, the substrate stage has a circular top surface for supporting a circular substrate.

[Eleventh Form] According to an eleventh form, in the substrate holding device according to the tenth form, the stage drive mechanism has a motor for rotating the substrate stage, and the positioning pin is configured to position the substrate so that a center of the substrate coincides with a rotation center of the substrate stage.

[Twelfth Form] According to a twelfth form, a substrate processing apparatus is provided. The substrate processing apparatus includes the substrate holding device according to any one of the first to eleventh form, and the substrate processing apparatus is configured to perform processing on a substrate held by the substrate holding device.

[Thirteenth Form] According to a thirteenth form, the substrate processing apparatus according to the twelfth form includes a partial polisher partially polishing the substrate held by the substrate holding device.

DETAILED DESCRIPTION

Embodiments of a partial polisher including a substrate holding device according to the present invention are described below with reference to appended drawings. In the appended drawings, the same or similar elements are designated by the same or similar reference symbols, and in the descriptions of respective embodiments, descriptions about the same or similar elements may be omitted where such descriptions would be redundant. Additionally, unless features described in respective embodiments are contradictory to each other, the features are applicable to other embodiments.

Figure 1:
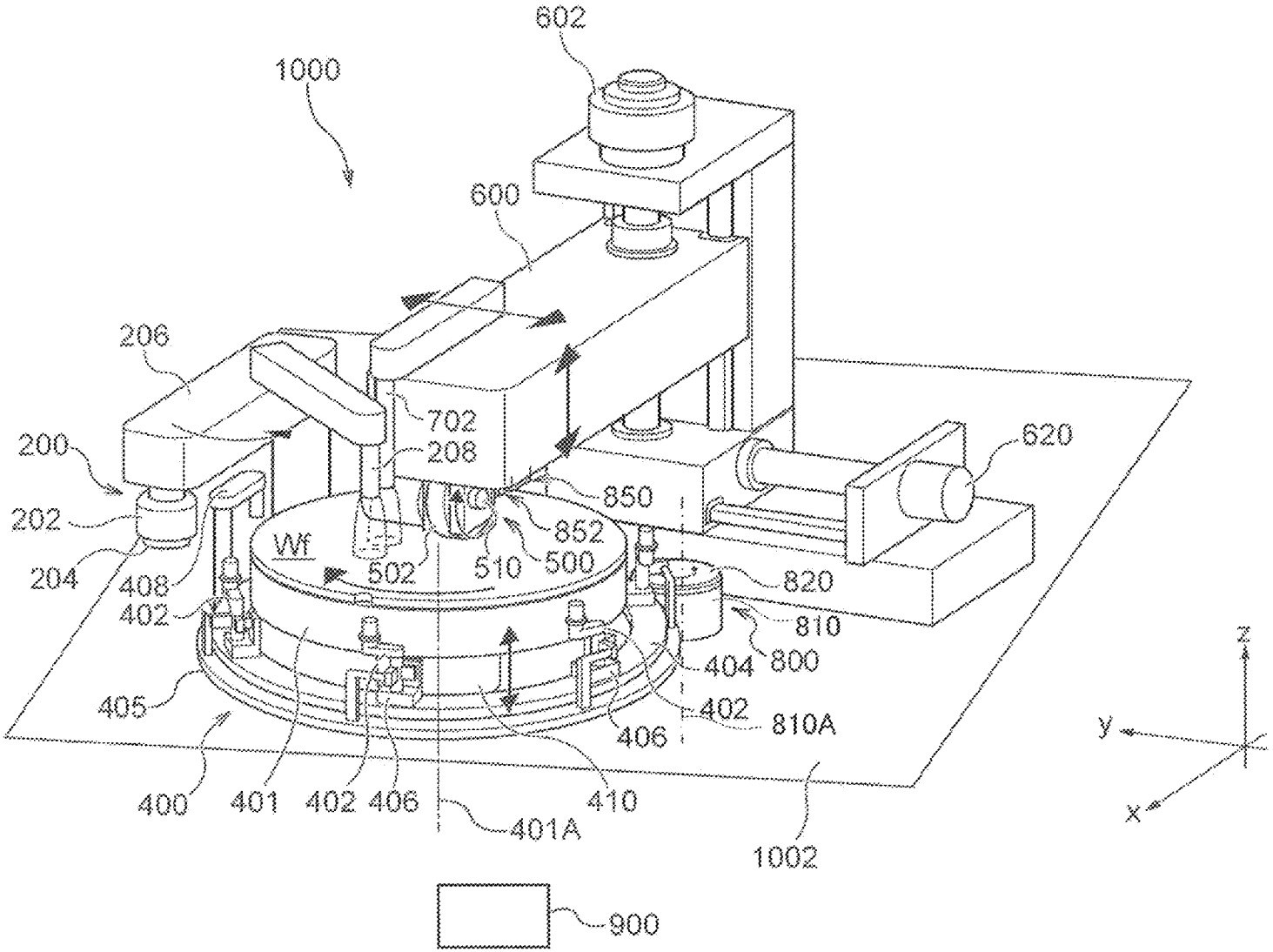
FIG. 1 is a schematic view illustrating a configuration of a partial polisher including a substrate holding device according to one embodiment.

FIG. 1 is a schematic view illustrating a configuration of a partial polisher 1000 including a substrate holding device 400 according to one embodiment. As illustrated in FIG. 1, the partial polisher 1000 is configured on a base surface 1002. The partial polisher 1000 may be configured as an independent single apparatus, or may be configured as a module that is part of a substrate processing system 1100 including a large-diameter polisher 1200 using a large-diameter polishing pad along with the partial polisher 1000 (see FIG. 1). The partial polisher 1000 is installed in an enclosure which is not illustrated. The enclosure includes an exhaust mechanism which is not illustrated, and is configured not to expose a polishing liquid and the other components to the exterior of the enclosure during polishing.

As illustrated in FIG. 1, the partial polisher 1000 includes the substrate holding device 400 for holding a substrate Wf. The substrate holding device 400 includes a stage 401 that holds the substrate Wf in such a way that the substrate Wf faces upward. The stage 401 includes a rotational drive mechanism 410, and is configured to be rotatable around a rotation axis 401A. In one embodiment, the substrate Wf can be placed on the stage 401 by a transporter which is not illustrated. In the substrate holding device 400 in the partial polisher 1000 illustrated in FIG. 1, six positioning pins 402 are provided around the stage 401 (only four positioning pins 402 are illustrated in FIG. 1). Each of the six positioning pins 402 is attached to an annular pin stage 404 through a pedestal 406. The six positioning pins 402 have the same dimensions, and are arranged at an equal distance from the annular pin stage 404 in a radial direction. In the illustrated embodiment, the six positioning pins 402 are arranged at equal intervals in the circumferential direction. However, the arrangement of the positioning pins 402 in the circumferential direction need not be necessarily arranged at the equal intervals. For example, when the positioning pins 402 are not arranged at the equal intervals, and the annular pin stage 404 is divided by any diameter into two parts, the positioning pins 402 can be arranged so that the positioning pins 402 on both halves of the annular pin stage 404 are positioned in a symmetrical pattern with respect to the diameter. Alternatively, the positioning pins 402 may be arranged at any intervals in the circumferential direction. The pin stage 404 is configured to be movable in a direction (z direction) perpendicular to a top surface of the stage 401 as described later. Therefore, the positioning pins 402 are movable in the direction (z direction) perpendicular to the top surface of the stage 401. In addition, the pin stage 404 is configured to be rotatable together with the stage 401 as described later. Therefore, the positioning pins 402 are movable in the circumferential direction of the stage 401. A base member 405 is arranged below the pin stage 404. Unlike the pin stage 404, the base member 405 is configured not to rotate together with the stage 401. The pin stage 404 and the base member 405 are connected through a bearing 409 (see FIGS. 5A, 5B, and 5C), and the pin stage 404 can rotate with respect to the base member 405. The bearing 409 can be any bearing such as a thrust ball bearing, or a single row deep groove ball bearing. The base member 405 is configured to be movable in the direction (z direction) perpendicular to the top surface of the stage 401 by a drive mechanism which is not illustrated. Since the pin stage 404 is arranged on the base member 405 through the bearing 409, when the base member 405 is moved in the z direction, the pin stage 404 on the base member 405 is also moved together with the base member 405 in the z direction. In one embodiment, a component such as a roller, a ball, or a slide member that can guide a rotary motion may be used instead of the bearing 409.

Figure 2:
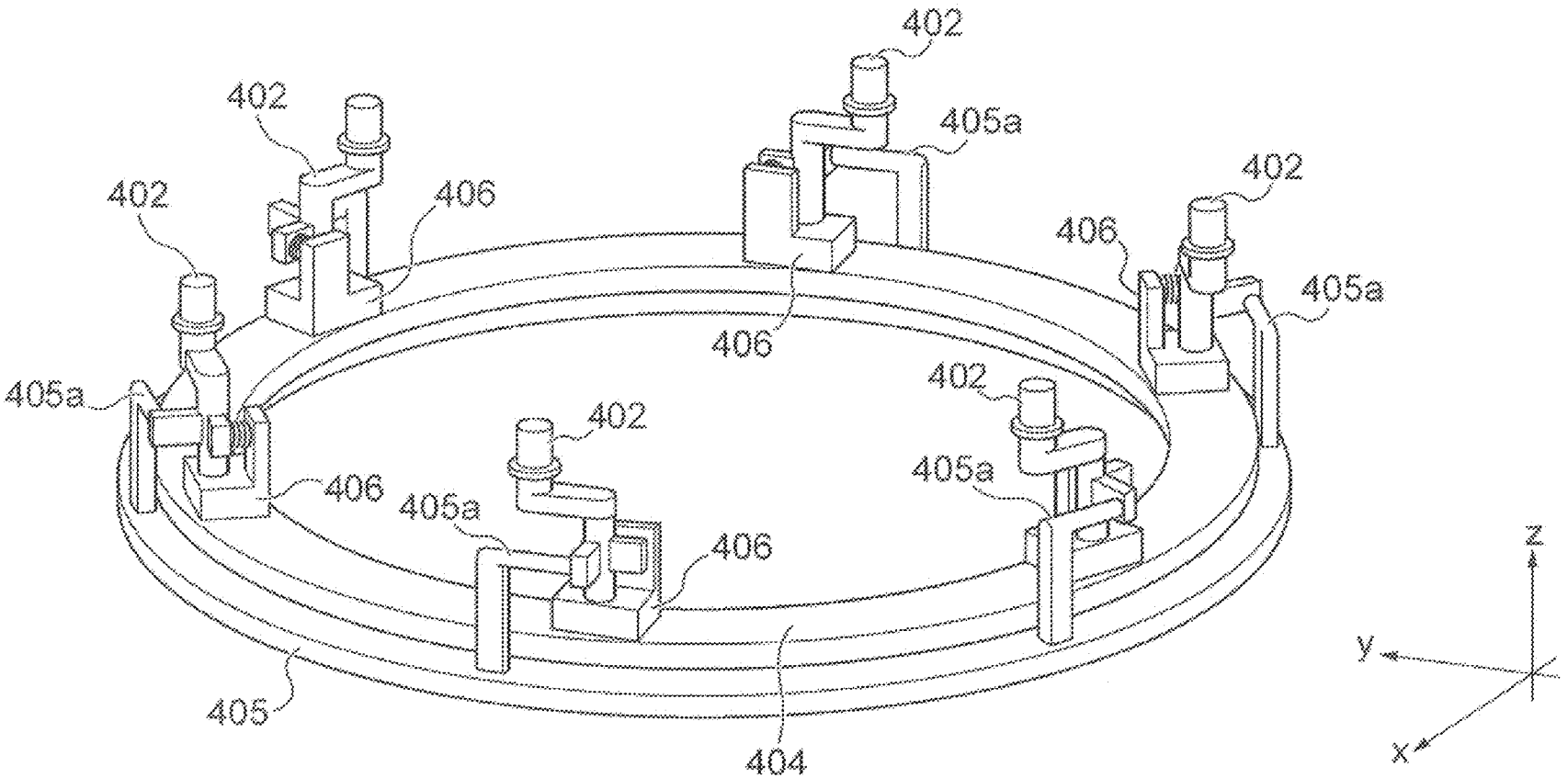
FIG. 2 is a perspective view illustrating positioning pins, a pin stage, a base member, and pedestals of the substrate holding device, which is illustrated in FIG. 1.
Figure 3A:
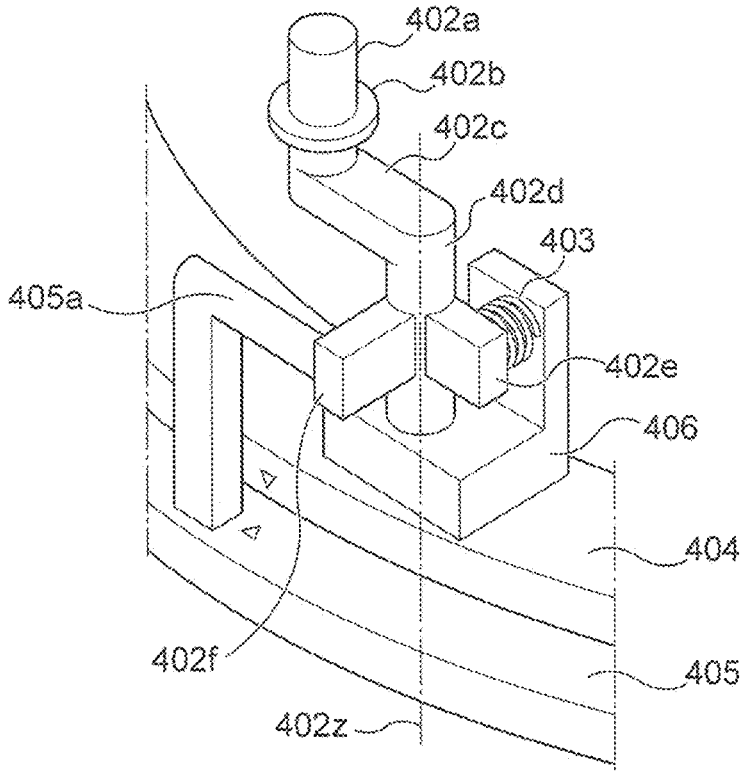
FIG. 3A is a perspective view illustrating a state in which the positioning pin is supported by a stopper member according to one embodiment.
Figure 3B:
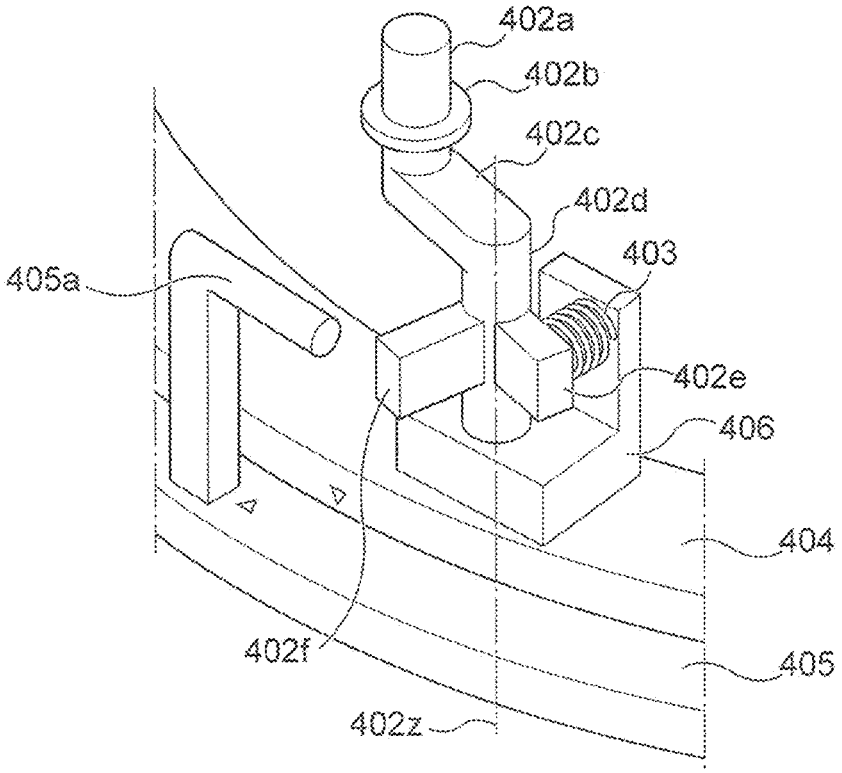
FIG. 3B is a perspective view illustrating a state in which the positioning pin is released from the stopper member according to one embodiment.

FIG. 2 is a perspective view illustrating the positioning pins 402, the pin stage 404, the base member 405, and the pedestals 406 of the substrate holding device 400, which is illustrated in FIG. 1. FIG. 3A and FIG. 3B each are a perspective view illustrating an enlargement of the vicinity of the one positioning pin 402. As illustrated in FIGS. 3A and 3B, each of the positioning pins 402 includes a cylindrical guide portion 402*a*. The guide portions 402*a* are configured to push the substrate Wf toward a central direction of the substrate Wf to position the substrate Wf on the stage 401 as described later. Each of the positioning pins 402 includes a substrate support portion 402*b* having a diameter larger than that of the guide portion 402*a*. As described later, the substrate Wf is supported by top surfaces of the substrate support portions 402*b* of the six positioning pins 402. Each of the positioning pins 402 further includes an arm portion 402*c* extending in an xy plane direction, and a cylindrical shaft portion 402*d*. The guide portion 402*a* and the substrate support portion 402*b* are connected to the cylindrical shaft portion 402*d* through the arm portion 402*c*. A center axis of the cylindrical shaft portion 402*d* defines a rotation axis 402*z* of the positioning pin 402, and each of the positioning pins 402 is configured to be rotatable around the rotation axis 402*z*. As illustrated in FIGS. 3A and 3B, a center axis of the cylindrical guide portion 402*a* and the substrate support portion 402*b* is not coincident with the rotation axis 402*z*. Therefore, when the positioning pin 402 rotates around the rotation axis 402*z*, the guide portion 402*a* and the substrate support portion 402*b* can be moved in a direction parallel to the plane (xy plane) of the stage 401. A motion direction of the guide portion 402*a* and the substrate support portion 402*b* when the positioning pin 402 rotates is an approximate radial direction of the stage 401. The illustrated positioning pin 402 further includes an elastic member contact portion 402*e* and a stopper contact portion 402*f*. As illustrated in FIGS. 3A and 3B, the pedestal 406 is fixed to the pin stage 404, and an elastic member 403 serving as an urging member is arranged between the pedestal 406 and the elastic member contact portion 402*e* of the positioning pin 402. The elastic member 403 can be any urging member. In one embodiment, the elastic member 403 can be a spring plunger or a coil spring. Note that in the illustrated embodiment, the elastic member 403 is used as an urging member, but in the other embodiments, an urging member such as a magnet which is not an elastic member may be used. The elastic member 403 is configured to rotate the positioning pin 402 to urge the positioning pin 402 in a direction in which the guide portion 402*a* moves toward the interior of the stage 401. As illustrated in FIG. 2, the base member 405 is provided with six stopper members 405*a* to correspond to the respective positioning pins 402. The stopper contact portions 402*f* of the respective positioning pins 402 are configured to be in contact with the base member 405. FIG. 3A illustrates a state in which the positioning pin 402 is supported by the stopper member 405*a*. In the state illustrated in FIG. 3A, the stopper member 405*a* applies a force which counteracts against the urging force of the elastic member 403 to the positioning pin 402, so that the guide portion 402*a* is moved toward the exterior of the stage 401. From the state illustrated in FIG. 3A, the pin stage 404 is rotated counterclockwise when viewed in FIG. 2 and FIG. 3A, so that the stopper contact portion 402*f* of the positioning pin 402 moves away from the stopper member 405*a*. Then, an elastic force of the elastic member 403 pushes the elastic member contact portion 402*e* to rotate the positioning pin 402, so that the guide portion 402*a* and the substrate support portion 402*b* move in an inward direction of the stage 401. FIG. 3B illustrates such a state.

Figure 4A:
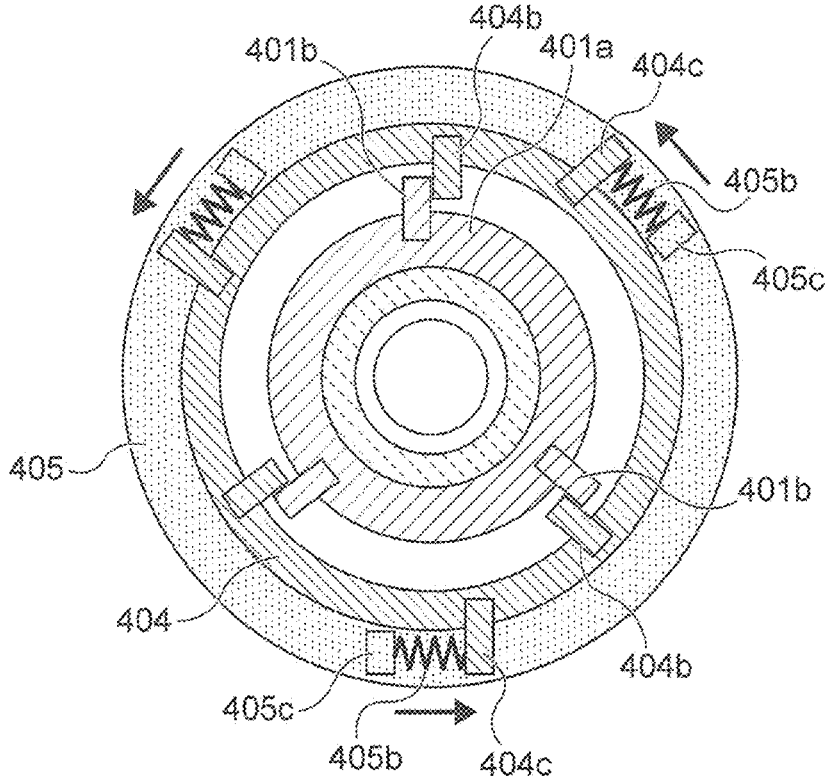
FIG. 4A is a schematic view illustrating the substrate holding device of the partial polisher according to one embodiment as viewed from below.
Figure 4B:
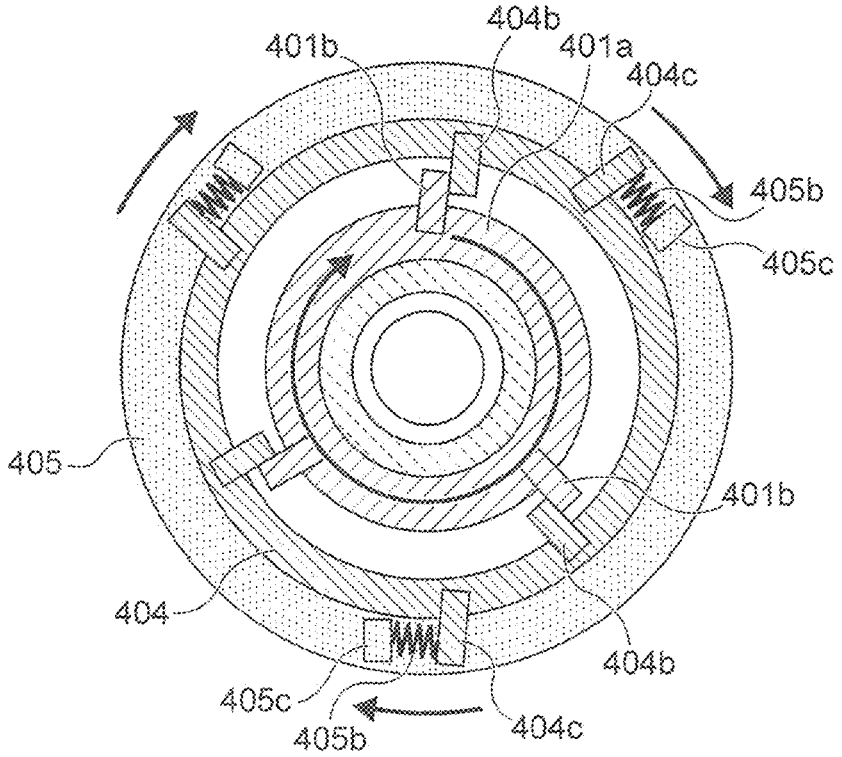
FIG. 4B is a schematic view illustrating the substrate holding device of the partial polisher according to one embodiment as viewed from below, and illustrates a state in which a stage and a pin stage are rotated clockwise from the state in FIG. 4A.
Figure 5A:
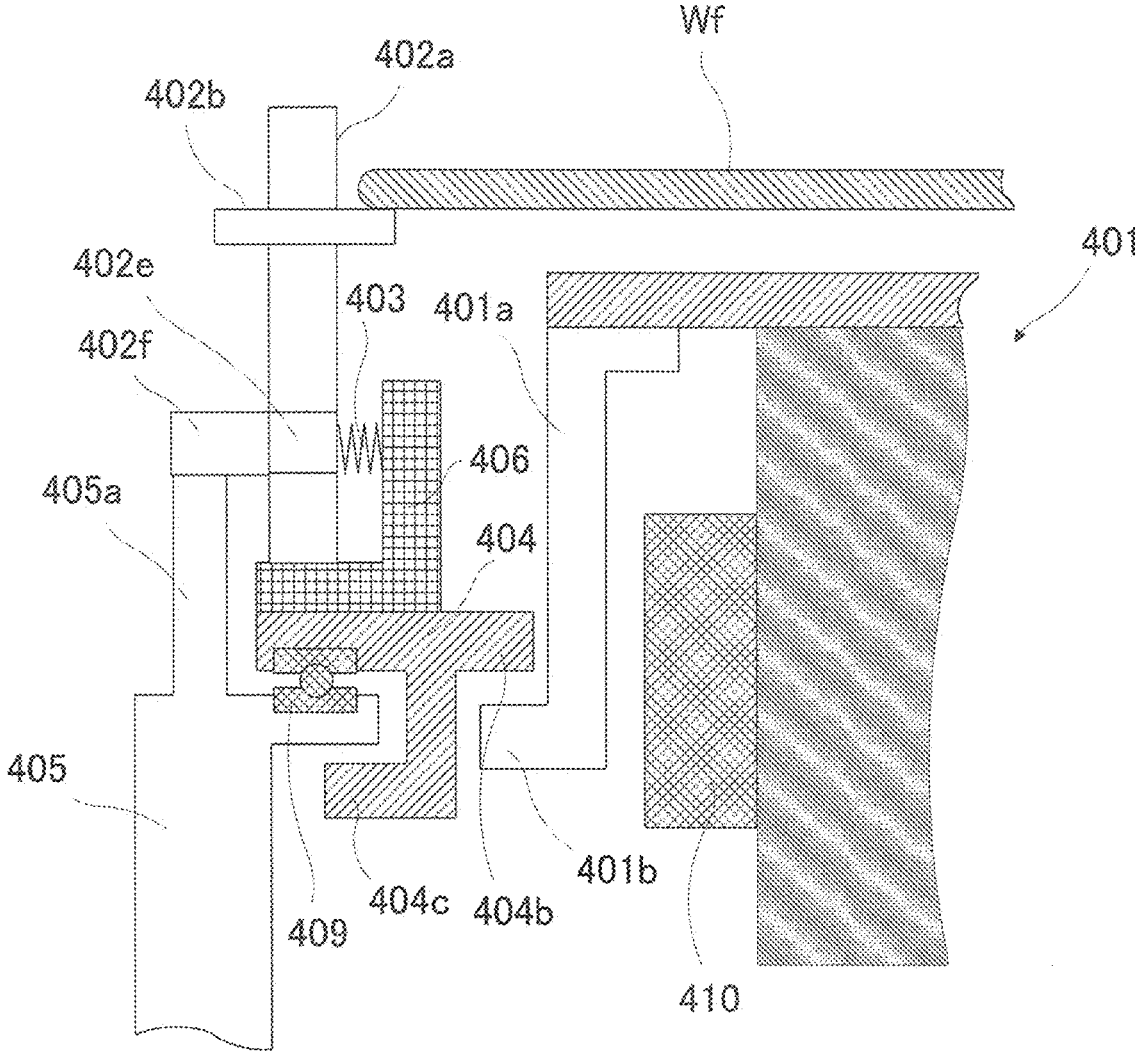
FIG. 5A is a partial cross-sectional view illustrating the substrate holding device according to one embodiment in a state in which the pin stage is located at a first position (upper stage)
Figure 5B:
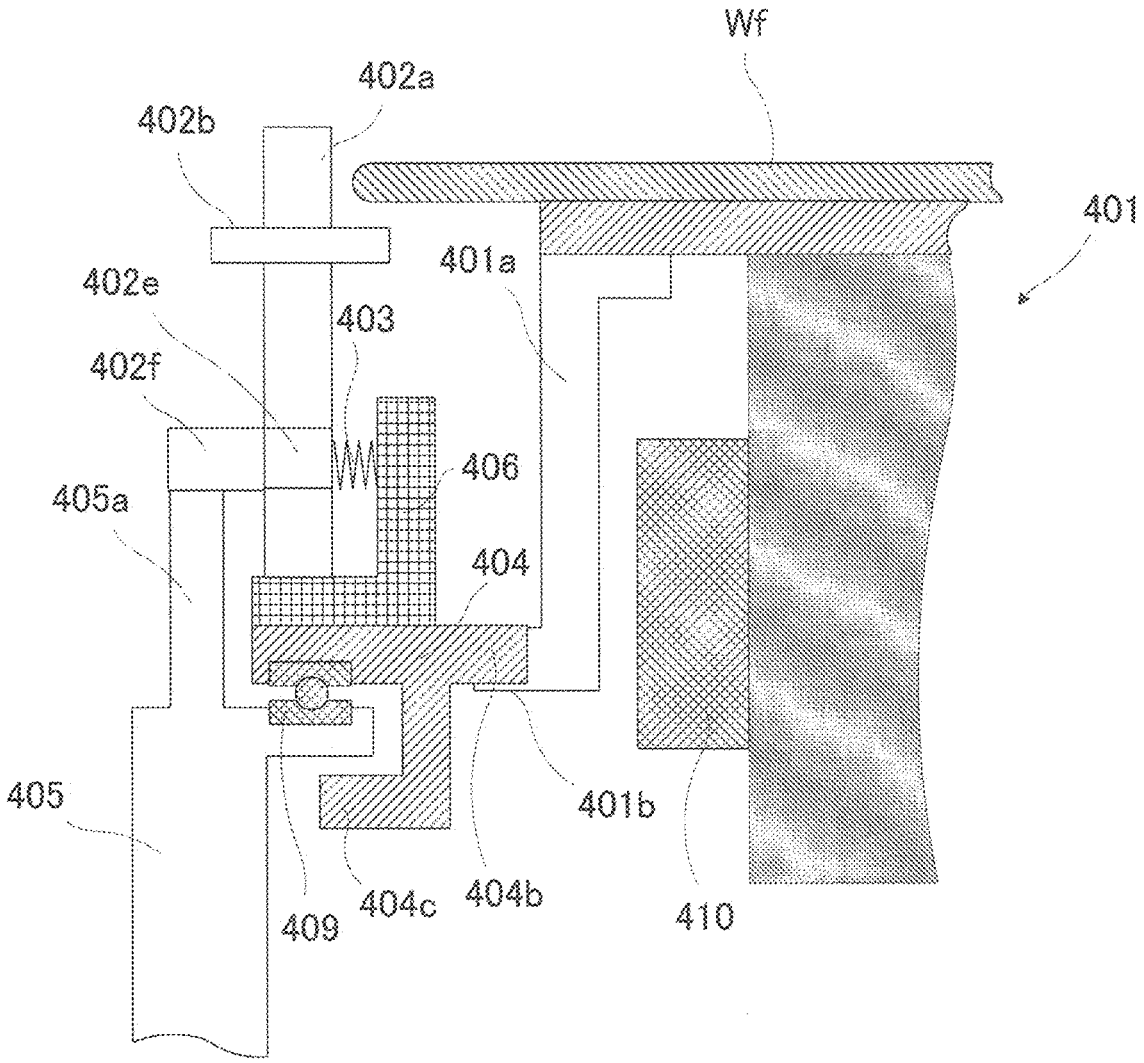
FIG. 5B is a partial cross-sectional view illustrating the substrate holding device according to one embodiment in a state in which the pin stage is located at a second position (middle stage)
Figure 5C:
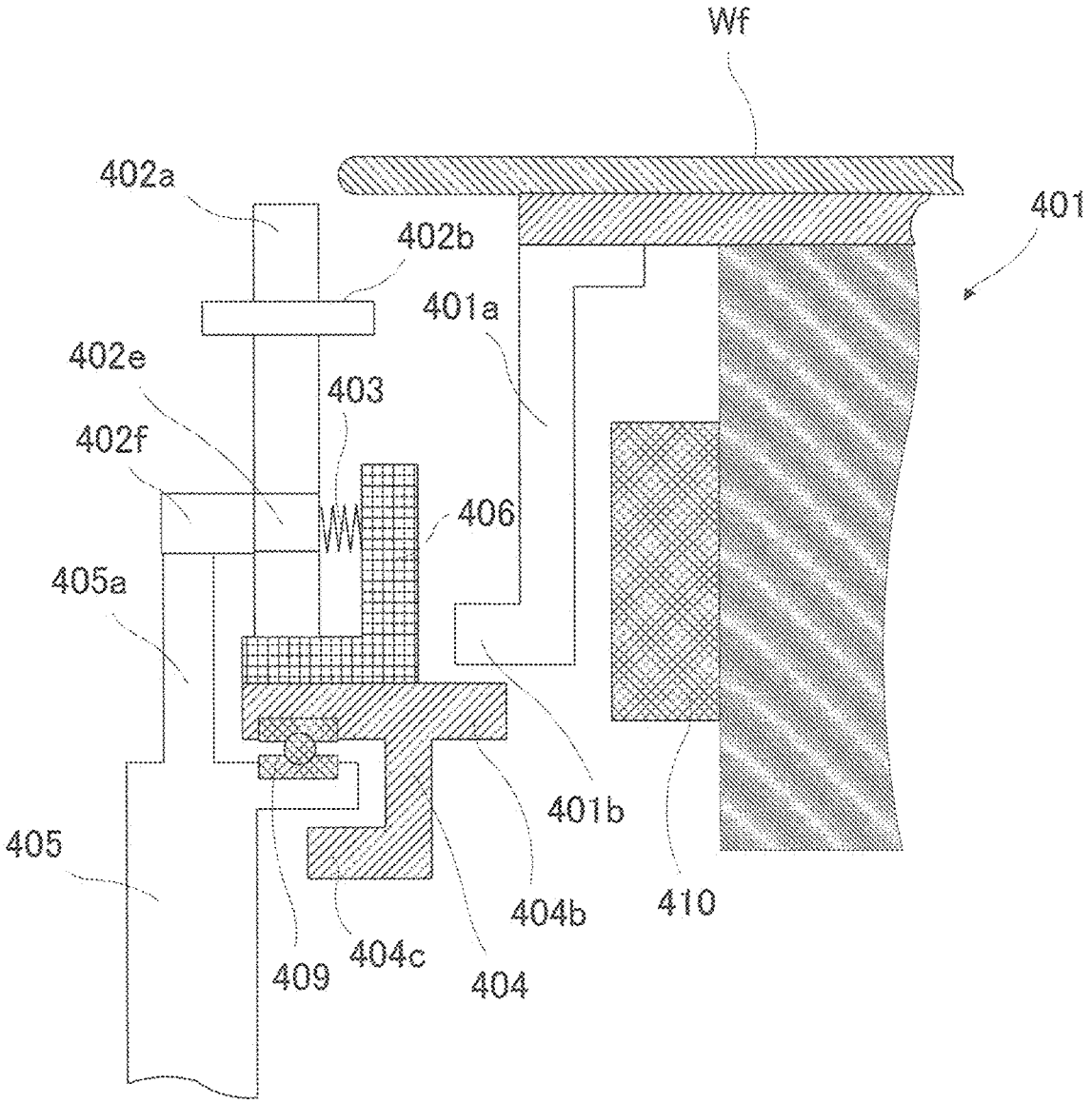
FIG. 5C is a cross-sectional view illustrating the substrate holding device according to one embodiment in a state in which the pin stage is located at a third position (lower stage)
Figure 6A:
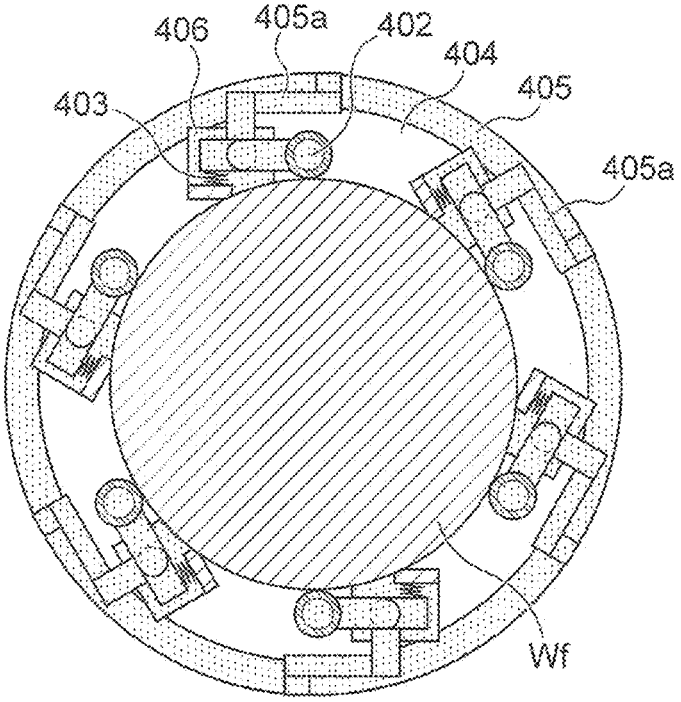
FIG. 6A is a schematic view illustrating the substrate holding device of the partial polisher according to one embodiment as viewed from above.
Figure 6B:
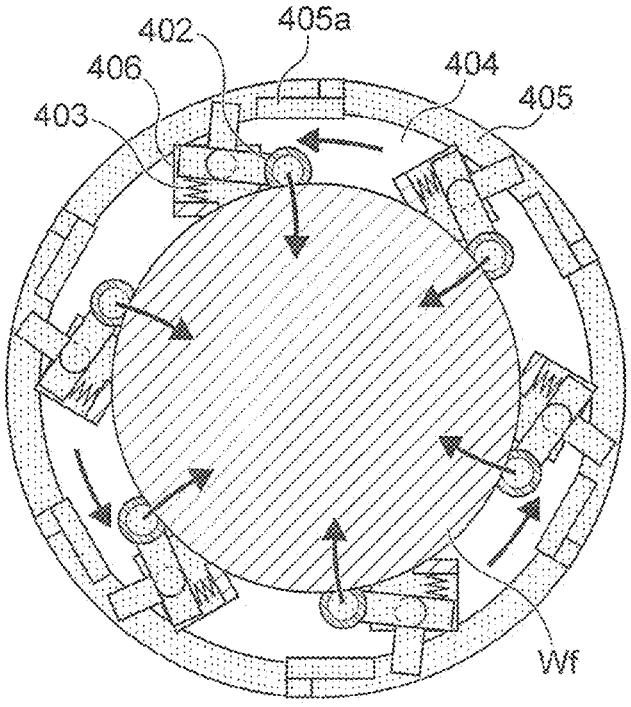
FIG. 6B is a schematic view illustrating the substrate holding device of the partial polisher according to one embodiment as viewed from above, and illustrates a state in which the stage and the pin stage are rotated counterclockwise from the state in FIG. 6A.

FIGS. 4A and 4B each are a schematic view illustrating the substrate holding device 400 of the partial polisher 1000 illustrated in FIG. 1 as viewed from below (in the z direction). FIGS. 5A, 5B and 5C each are a partial cross-sectional view of the substrate holding device 400 of the partial polisher 1000 illustrated in FIG. 1 which is cut out in a radial direction of the stage 401. FIGS. 6A and 6B each are a schematic view illustrating the substrate holding device 400 of the partial polisher 1000 illustrated in FIG. 1 as viewed from above (in the −z direction). As illustrated in FIGS. 4A and 4B, the stage 401 includes a stage main body 401*a* that is rotated by a motor serving as the rotational drive mechanism 410. The stage main body 401*a* is provided with first engagement portions 401*b*. In one embodiment, the first engagement portions 401*b* each are a protruding portion extending radially outwardly from the stage main body 401*a* as illustrated in FIGS. 4A and 4B and FIGS. 5A, 5B, and 5C. The pin stage 404 is provided with first engagement portions 404*b* each engaging with the corresponding first engagement portion 401*b* of the stage main body 401*a*. Each of the first engagement portions 404*b* of the pin stage 404 can be a protruding portion extending radially inwardly as illustrated in FIGS. 4A and 4B and FIGS. 5A, 5B, and 5C. Furthermore, the pin stage 404 is provided with second engagement portions 404*c*. In one embodiment, the second engagement portions 404*c* each are a protruding portion extending radially outwardly from the annular pin stage 404. The base member 405 includes second engagement portions 405*c* each engaging with the corresponding second engagement portion 404*c* of the pin stage 404 through a corresponding elastic member 405*b* serving as an urging member. The elastic member 405*b* can be, for example, a coil spring. The elastic member 405*b* is arranged to urge the pin stage 404 in a direction opposite to the rotational direction of the stage. In other words, the elastic member 405*b* is configured to urge the pin stage 404 toward the state of the pin stage 404 illustrated in FIG. 3A from the state illustrated in FIG. 3B. Note that in the illustrated embodiment, the elastic member 405*b* is used as an urging member, but in the other embodiments, an urging member such as a magnet which is not an elastic member may be used.

When the stage 401 is rotated by the rotational drive mechanism 410 in a state in which each of the first engagement portions 401*b* of the stage 401 is engaged with the corresponding first engagement portion 404*b* of the pin stage 404, the pin stage 404 also rotates together with the stage 401. FIG. 4B illustrates a state in which the stage 401 and the pin stage 404 are rotated clockwise when viewed in FIG. 4B from the state illustrated in FIG. 4A. When a driving force to the stage 401 is stopped, the pin stage 404 is returned, by the elastic members 405*b*, to the original position, i.e., the position illustrated in FIG. 4A. Thus, the above-described positioning pins 402 can be moved using the rotational drive mechanism 410 of the stage 401.

In the state illustrated in FIG. 4A, the positioning pin 402 is in the state illustrated in FIG. 3A, and the guide portion 402*a* and the substrate support portion 402*b* of the positioning pin 402 are moved radially outwardly by the stopper member 405*a* of the base member 405. FIG. 6A is a diagram illustrating such a state as viewed from above. As illustrated in FIG. 6A, in this state, the substrate Wf is supported by the substrate support portions 402*b* of the six positioning pins 402. When the stage 401 is rotated from such a state as illustrated in FIG. 4B, the pin stage 404 is rotated, each of the positioning pins 402 is released from the corresponding stopper member 405*a* as illustrated FIG. 3B, and each of the guide portions 402*a* of the respective positioning pins 402 is moved radially inwardly by the corresponding elastic member 403. Thus, the substrate Wf supported by the substrate support portions 402*b* of the respective positioning pins 402 is pushed by the guide portions 402*a* of the six positioning pins 402 in the central direction to be positioned so that a rotation center of the stage 401 coincides with a center of the substrate Wf. FIG. 6B is a diagram illustrating such a state as viewed from above.

As described above, the pin stage 404 is movable in a direction perpendicular to the top surface of the stage 401, so that the pin stage 404 can engage with and disengage from the stage 401. FIG. 5A is a partial cross-sectional view illustrating a state in which the pin stage 404 is located at a first position (upper stage). As illustrated in FIG. 5A, at the first position, the first engagement portion 401*b* of the stage 401 is separated from the first engagement portion 404*b* of the pin stage 404 in the height direction (z direction), so that the first engagement portion 401*b* is not engaged with the first engagement portion 404*b*. Therefore, even when the stage 401 is rotated in this state, a rotational force of the stage 401 is not transmitted to the pin stage 404. At the first position, the substrate support portion 402*b* of the positioning pin 402 is located higher than the top surface of the stage 401, and the substrate Wf is transferred between a transport mechanism which is not illustrated and the positioning pins 402 at the first position.

FIG. 5B is a partial cross-sectional view illustrating a state in which the pin stage 404 is located at a second position (middle stage). As illustrated in FIG. 5B, at the second position, the first engagement portion 401*b* of the stage 401 is located at the same level as the first engagement portion 404*b* of the pin stage 404, so that the first engagement portion 401*b* can engage with the first engagement portion 404*b*. At the second position, the substrate support portion 402*b* of the positioning pin 402 is slightly lower than the top surface of the stage 401, so that the guide portion 402*a* is brought to a position capable of contacting a peripheral edge portion of the substrate Wf on the stage 401. Thus, when the stage 401 is rotated in this state, the rotational force of the stage 401 is transmitted to the pin stage 404 to move the positioning pin 402 as described above, so that the positioning pin 402 can be released from the stopper member 405*a*.

FIG. 5C is a cross-sectional view illustrating a state in which the pin stage 404 is located at a third position (lower stage). As illustrated in FIG. 5C, at the third position, the first engagement portion 401*b* of the stage 401 is separated from the first engagement portion 404*b* of the pin stage 404 in the height direction (z direction), so that the first engagement portion 401*b* is not engaged with the first engagement portion 404*b*. Therefore, even when the stage 401 is rotated in this state, the rotational force of the stage 401 is not transmitted to the pin stage 404. At the third position, the whole positioning pin 402 is located lower than the top surface of the stage 401. At the third position, partial polishing is performed on the substrate Wf supported by the stage 401.

In the substrate holding device 400 according to the present embodiment, the placement and positioning of the substrate Wf on the stage 401 are performed as follows. As illustrated in FIG. 5A, the positioning pin 402 is moved to the first position which is the upper stage. At this position, the substrate Wf is transferred from the transporter which is not illustrated to the substrate support portions 402*b* of the six positioning pins 402 so as to be supported by the substrate support portions 402*b*. After the substrate Wf is placed on the substrate support portions 402*b*, the positioning pins 402 are lowered to the second position illustrated in FIG. 5B, and the substrate Wf is temporarily placed on the stage 401. When at this position, the stage 401 is rotated as described above, the substrate Wf is positioned on the stage 401 by the six positioning pins 402 so that the center of the substrate Wf coincides with the rotation center of the stage 401. When the substrate Wf is positioned, the substrate Wf is fixed onto the stage 401 by means of vacuum chucking or the like. When the substrate Wf is fixed onto the stage 401, the positioning pins 402 are lowered to the third position which is the lower stage illustrated in FIG. 5C. At such a position, a variety of types of processing such as partial polishing can be performed on the substrate Wf fixed onto the stage 401.

As described above, in the substrate holding device 400 according to the present embodiment, the motive power from the rotational drive mechanism 410 that is originally included in the stage 401 of the partial polisher 1000 is used for the positioning of the substrate Wf, as described later. Therefore, an additional motive power source is not needed to move the positioning pins 402. Furthermore, the positioning pins 402 according to the present embodiment are also used for transfer of the substrate Wf, and therefore are not components added only for a positioning function. Since the substrate is positioned by actively moving the positioning pins 402, the reliability of the positioning of the substrate is more improved than in the case where the substrate is positioned by a passive action as disclosed in PTL 2. In the present embodiment, the substrate Wf is positioned by moving a plurality of movable positioning pins 402 from the exterior toward the center of the substrate Wf, thereby preventing the center of the substrate Wf from deviating from the center of the stage due to the error in substrate size, the deviation being generated when the substrate Wf is positioned by being pushed from only one side of the substrate Wf.

In the illustrated embodiment, the number of positioning pins 402 is six, but any number of three or more positioning pins 402 can be employed. However, when the number of positioning pins 402 is three, a position of an orientation flat or a notch portion of the substrate Wf may correspond to the positioning pin 402, and in this case, there is a possibility that the substrate Wf cannot be accurately positioned. Therefore, it is preferable that the number of positioning pins 402 is four or more, or as in the illustrated embodiment, the number of positioning pins 402 is six or more. In the illustrated embodiment, the stage 401 is rotated, and the positioning pins 402 are released from the respective stopper members 405*a*, so that the guide portions 402*a* of the respective positioning pins 402 are moved inwardly using the forces of the respective elastic members 403. On the contrary, the guide portions 402*a* of the respective positioning pins 402 may be moved inwardly by the rotation of the stage 401, and the guide portions 402*a* of the respective positioning pins may be moved outwardly by the respective elastic members 403. For example, the arm portion 402*c* of the positioning pin 402 illustrated in FIGS. 3A and 3B is configured to extend to the opposite side of the circumferential direction of the pin stage 404, so that such an embodiment can be implemented. Note that since in such an embodiment, the positioning pins 402 are moved inwardly by the rotation of the rotational drive mechanism 410, when abnormality occurs in the rotational drive mechanism 410, resulting in generating large forces, the positioning pins 402 applies the large forces to the substrate Wf, which may cause breakage in the substrate Wf. Therefore, the illustrated embodiment in which the forces of the elastic members 403 urge the respective positioning pins 402 inwardly is more preferable.

The description will return to the partial polisher 1000 illustrated in FIG. 1. The partial polisher 1000 illustrated in FIG. 1 includes a detection section 408. The detection section 408 is intended to detect the position of the substrate Wf placed on the stage 401. For example, the detection section 408 can detect a notch or an orientation flat formed on the substrate Wf or the outer circumference of the substrate to detect the position of the substrate Wf on the stage 401. Using the position of the notch or the orientation flat as a reference allows identification of an arbitrary point on the substrate Wf, thereby allowing partial polishing of a desired region. Furthermore, since information on the position of the outer circumference of the substrate provides information on the position of the substrate Wf on the stage 401 (amount of deviation with respect to ideal position, for example), the position to which a polishing pad 502 is moved may be corrected by a controller 900 based on the information. Note that, to detach the substrate Wf from the stage 401, the positioning pins 402 are moved to the position (FIG. 5B) where the substrate is received from the stage 401, and the vacuum chucking via the stage 401 is then deactivated. The positioning pins 402 are then further lifted to move the substrate Wf to the position (FIG. 5A) where the substrate is transferred to the transporter, and the transporter which is not illustrated can then receive the substrate Wf on the positioning pins 402. The substrate Wf can then be transported by the transporter to an arbitrary location for subsequent processing.

Figure 11:
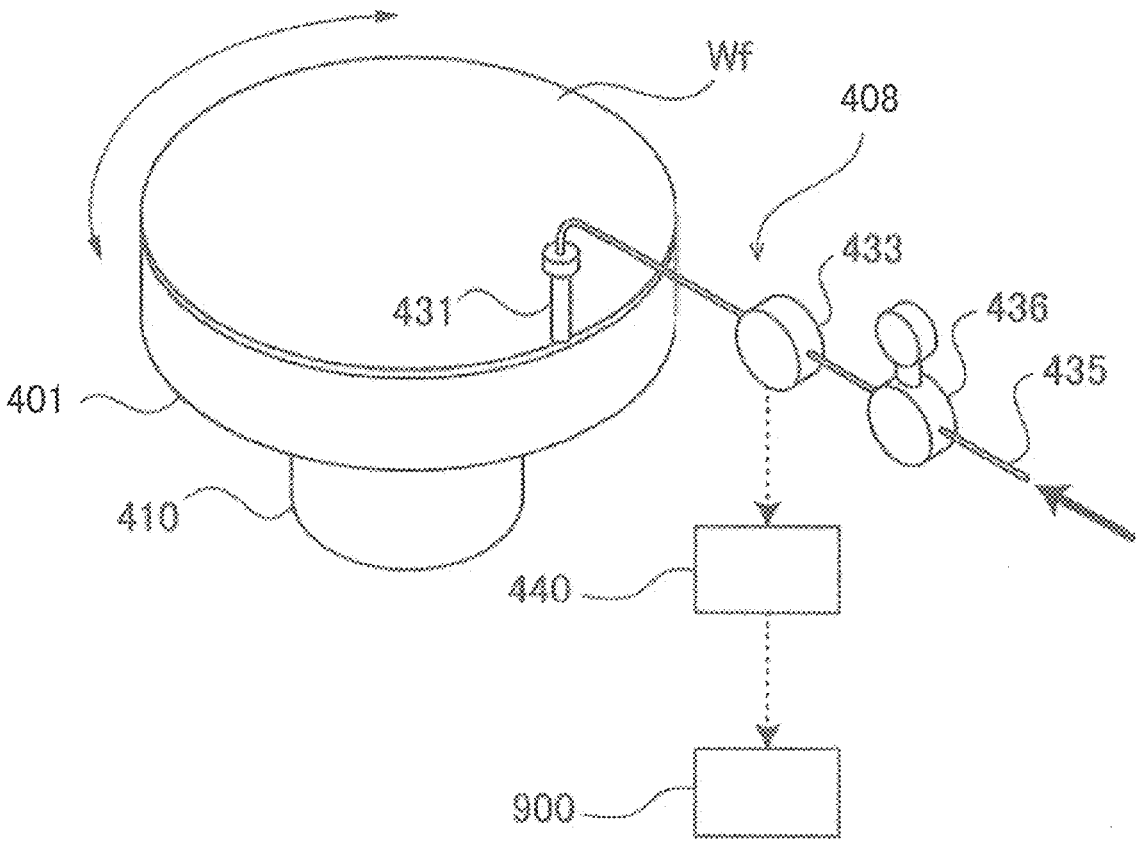
FIG. 11 is a schematic view illustrating a detection section 408 illustrated in FIG. 1, according to one embodiment.

FIG. 11 is a schematic view illustrating the detection section 408 illustrated in FIG. 1. The detection section 408 includes a fluid jet nozzle 431 configured to jet out fluid toward the peripheral edge portion of the substrate, a fluid measuring device 433 configured to measure a physical quantity of the fluid, a fluid supply pipe 435 configured to supply the fluid to the fluid jet nozzle 431, a pressure regulator 436 attached to the fluid supply pipe 435, and a position detector 440 configured to detect a position of a cut formed in the peripheral edge portion of the substrate Wf based on change in the fluid physical quantity. The fluid jet nozzle 431 is disposed downward in the vertical direction so that a distal end of the fluid jet nozzle 431 faces the stage 401, and is connected to the fluid supply pipe 435.

In the present embodiment, the fluid physical quantity to be measured is the pressure or flow rate of the fluid. The fluid measuring device 433 is any one of a pressure sensor and a flow rate sensor. In one embodiment, the fluid measuring device 433 may be provided with both of the pressure sensor and the flow rate sensor. The fluid measuring device 433 is electrically connected to the position detector 440 to transmit a measured value of the fluid physical quantity to the position detector 440. The position detector 440 is electrically connected to the controller 900. The position detector 440 detects a position of the cut on the substrate Wf based on change in the measured value of the fluid, and transmits the information on the position of the cut on the substrate Wf to the controller 900.

As indicated by an arrow in FIG. 11, the fluid is supplied from a fluid supply source (not illustrated) provided outside the partial polisher 1000 to the fluid jet nozzle 431 through the fluid supply pipe 435. The fluid supply source can be, for example, a canister, or a factory fluid supply line in which the partial polisher 1000 is installed. The pressure of the fluid supplied to the fluid supply pipe 435 is stabilized and is maintained at a constant level by the pressure regulator 436. In the present embodiment, the above-described fluid is a liquid such as pure water, but in one embodiment, the above-described fluid may be gas such as clean air, or $N_2$ gas.

Next, a method of detecting a cut (e.g. a notch or an orientation flat) by the detection section 408 will be described in detail. The substrate Wf is placed on a surface of the stage 401 by the six positioning pins 402. The substrate Wf is held on the stage surface by means of the vacuum chucking. Then, the stage 401 is rotated together with the substrate Wf by the rotational drive mechanism 410. The rotational drive mechanism 410 can be formed, for example, of a servo motor such as a stepping motor.

Figure 12:
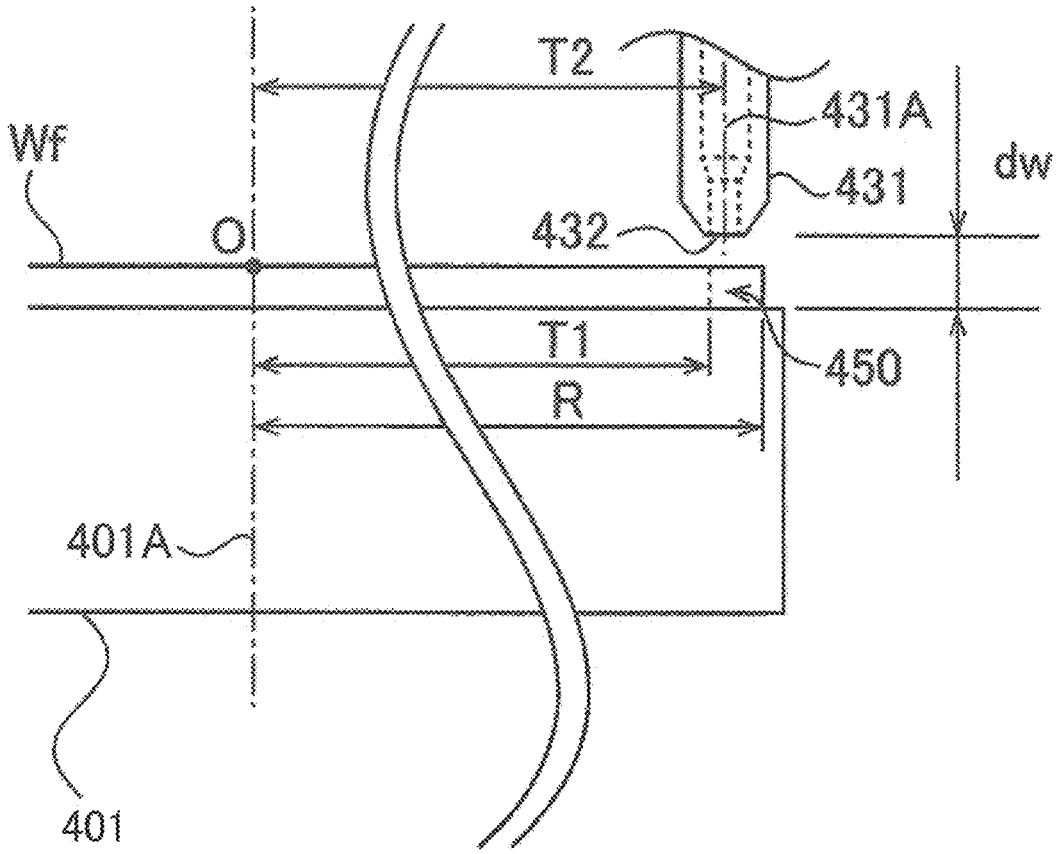
FIG. 12 is a side view illustrating a state in which a fluid jet nozzle illustrated in FIG. 11 is made close to the peripheral edge portion of the substrate, according to one embodiment.

The fluid jet nozzle 431 is moved above the peripheral edge portion of the substrate Wf by a nozzle movement mechanism which is not illustrated with the substrate Wf rotated. Then, the fluid jet nozzle 431 is lowered by the above-described nozzle movement mechanism so as to approach the peripheral edge portion of the substrate Wf rotating as illustrated in FIG. 12. FIG. 12 is a side view illustrating a state in which the fluid jet nozzle 431 is made close to the peripheral edge portion of the substrate Wf. A distance T2 between the axis 401A of the stage 401 and a center line 431A of the fluid jet nozzle 431 is equal to or larger than a distance T1 between a center O of the substrate Wf and the innermost end of a cut 450 formed on the peripheral edge portion of the substrate Wf, and is smaller than a radius R of the substrate Wf.

The fluid jet nozzle 431 has a jet orifice 432 of the fluid at a distal end thereof. The fluid jet nozzle 431 jets out the fluid downward in the vertical direction in the state in which the fluid jet nozzle 431 is made close to the peripheral edge portion of the substrate Wf. That is, the fluid is jetted out to the peripheral edge portion of the substrate Wf. The physical quantity such as a pressure of the fluid flowing through the fluid supply pipe 435 is measured by the fluid measuring device 433. The above-described physical quantity is measured per a predetermined unit time during jetting out of the fluid. Since the stage 401 is rotated during jetting out of the fluid, the fluid is jetted out on the entire circumferential surface of the peripheral edge portion of the substrate Wf. The fluid measuring device 433 transmits the measured value of the fluid physical quantity to the position detector 440. The fluid physical quantity is continuously measured while the substrate Wf rotates for a predetermined number of times. After the substrate Wf rotates for the predetermined number of times, the fluid jet nozzle 431 stops jetting out the fluid, and the fluid measuring device 433 ends the measurement of the fluid physical quantity.

Reducing the distance between the distal end of the fluid jet nozzle 431 and the surface of the substrate Wf leads to the improvement in the detection accuracy of the cut position. In the present embodiment, a distance dw from the distal end of the fluid jet nozzle 431 to the surface of the stage 401 is a distance obtained by adding a thickness of the substrate Wf to 0.05 mm to 0.2 mm. In one embodiment, after the pressure of the fluid supplied from the fluid supply source such as a factory fluid supply line is boosted with a pump or the like, the fluid may flow into the pressure regulator 436. Increasing the pressure of the fluid leads to the improvement in the detection accuracy of the cut position.

Figure 13:
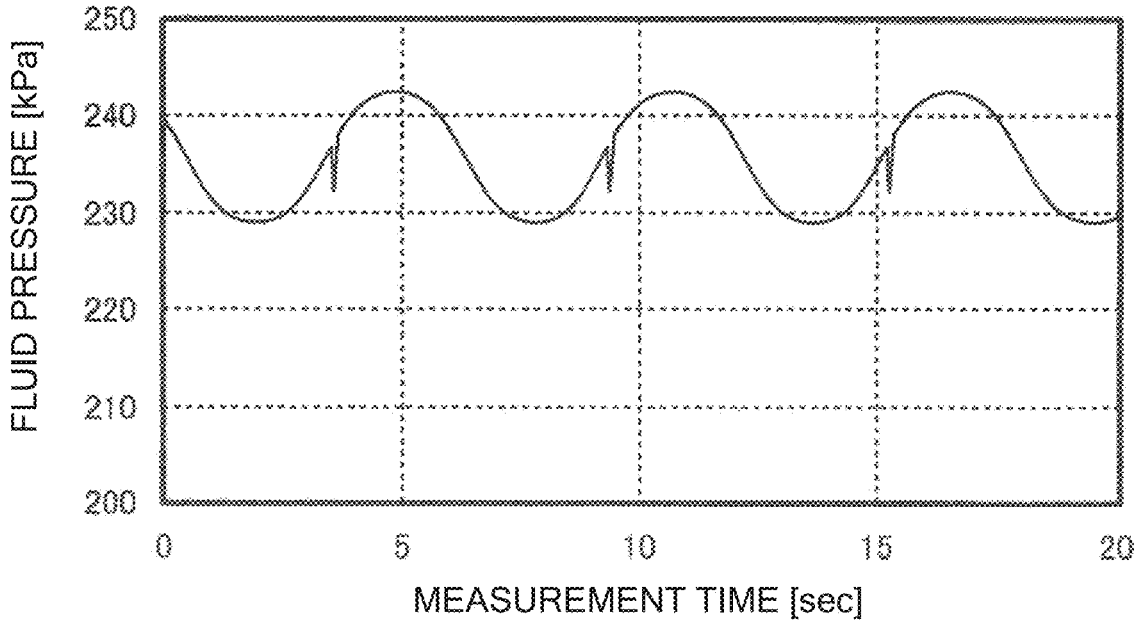
FIG. 13 is a graph showing a pressure as a physical quantity measured by a fluid measuring device, according to one embodiment.

FIG. 13 is a graph showing a pressure as a physical quantity measured by the fluid measuring device 433. In FIG. 13, a vertical axis represents the fluid pressure, and a horizontal axis represents the measurement time. The surface of the stage 401 is not completely perpendicular to the axis 401A of the stage 401. Therefore, during the rotation of the stage 401, the distance from the distal end of the fluid jet nozzle 431 to the peripheral edge portion of the substrate Wf (distance from the distal end of the fluid jet nozzle 431 to the surface of the substrate Wf) periodically fluctuates. During the jetting out of the fluid, the fluid pressure fluctuates in response to the above-described fluctuations in the distance. In the example shown in FIG. 13, this periodic fluctuation in the fluid pressure is represented as a sine wave.

Since the fluid is jetted out downward in the vertical direction from the fluid jet nozzle 431, when the stage 401 is rotated and the cut such as an orientation flat or a notch comes directly under the fluid jet nozzle 431, at least part of fluid jet passes through the cut of the substrate Wf and does not collide with the substrate Wf. As a result, the fluid physical quantity is rapidly changed (reduced). In the example shown in FIG. 13, the rapid reduction of pressure represents that the cut of the substrate Wf is positioned directly under the fluid jet nozzle 431.

Figure 14:
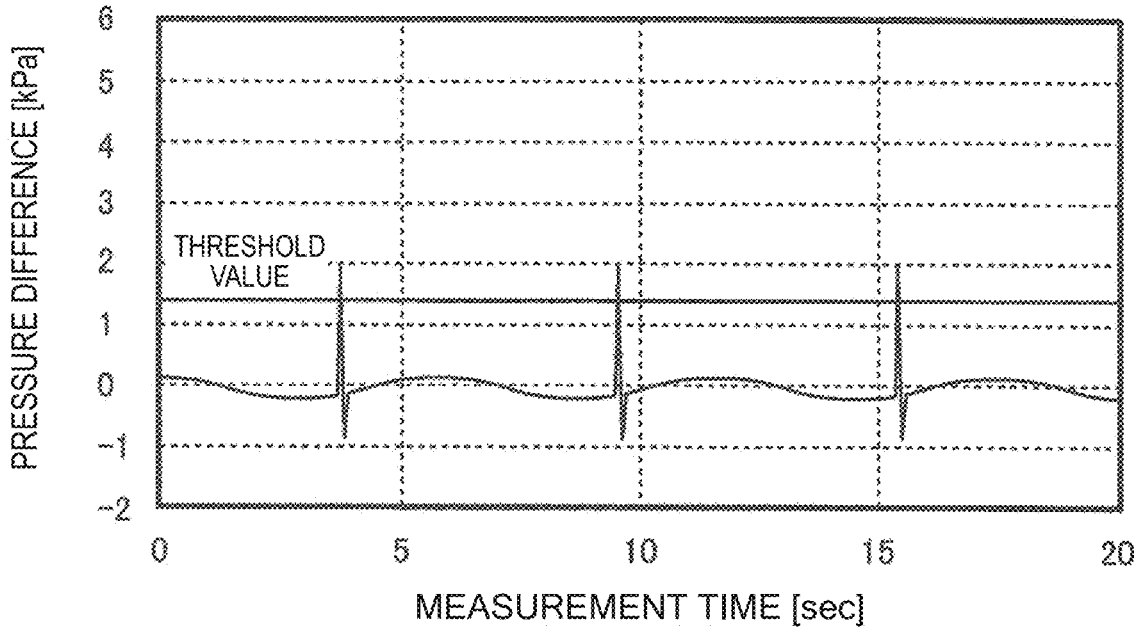
FIG. 14 is a graph showing a change in difference of the pressure as a physical quantity between the latest measured value and the previous measured value along a time axis, according to one embodiment.

FIG. 14 is a graph showing a pressure difference as a physical quantity measured by the fluid measuring device 433. Specifically, the graph shown in FIG. 14 shows the change in difference of the pressure as a physical quantity between the latest measured value and the previous measured value along a time axis. The position detector 440 calculates the difference of physical quantity between the latest measured value and the previous measured value each time the position detector 440 receives the latest measured value of the physical quantity from the fluid measuring device 433, and compares the calculated difference with a predetermined threshold value. The position detector 440 determines a cut position based on the above-described comparison result. The cut position can be identified from an angle of rotation around the axis 401A of the stage 401. In other words, the cut position can be indicated in terms of the angle of rotation around the axis 401A of the stage 401. The position detector 440 is connected to the rotational drive mechanism 410, so that a signal indicating the angle of rotation around the axis 401A of the stage 401 is transmitted to the position detector 440 from the rotational drive mechanism 410.

The position detector 440 determines the cut position based on the angle of rotation of stage 401 when the above-described difference reaches the threshold value. In the present embodiment, the position detector 440 determines the cut position identified from the angle of rotation of the stage 401 when the above-described difference reaches the threshold value. In one embodiment, the position detector 440 may calculate a corrected angle of rotation by adding a predetermined angle to the angle of rotation of the stage 401 when the above-described difference reaches the threshold value, and determine the cut position identified from the corrected angle of rotation.

When the surface of the stage 401 is completely perpendicular to the axis 401A of the stage 401, the fluid physical quantity is not represented as a sine wave as shown in FIG. 13. In this case, the position detector 440 may compare the measured value of the physical quantity with the predetermined threshold value, and determine the cut position of the substrate Wf based on the comparison result. In one embodiment, the position detector 440 determines the cut position based on the angle of rotation of the stage 401 when the measured value of the physical quantity reaches the threshold value.

In one embodiment, the detection section 408 may jet out the fluid to the peripheral edge portion of the substrate Wf while rotating the substrate Wf and the stage 401 in a first direction (clockwise, for example), and detect a first cut position of the substrate Wf using the method described with reference to FIG. 11 to FIG. 14, and further may jet out the fluid to the peripheral edge portion of the substrate Wf while rotating the substrate Wf and the stage 401 in a second direction opposite to the first direction (counterclockwise, for example), and detect a second cut position of the substrate Wf using the method described with reference to FIG. 11 to FIG. 14, such that an average of the first cut position and the second cut position is determined as the above-described cut position of the substrate Wf. The first cut position and the second cut position are identified from the angle of rotation of the substrate Wf, and the average of the first cut position and the second cut position can be indicated in terms of the angle of rotation of the substrate Wf. Thus, rotating the substrate Wf in both directions enables more accurate detection of the cut position.

As described above, the detection section 408 detects the cut position of the substrate Wf by measuring the fluid physical quantity which is a pressure or a flow rate. The pressure and the flow rate do not fluctuate due to slurry used in the polishing process and water drops, and do not substantially fluctuate depending on the measurement environment. As a result, the detection section 408 can detect the accurate cut position.

Figure 15:
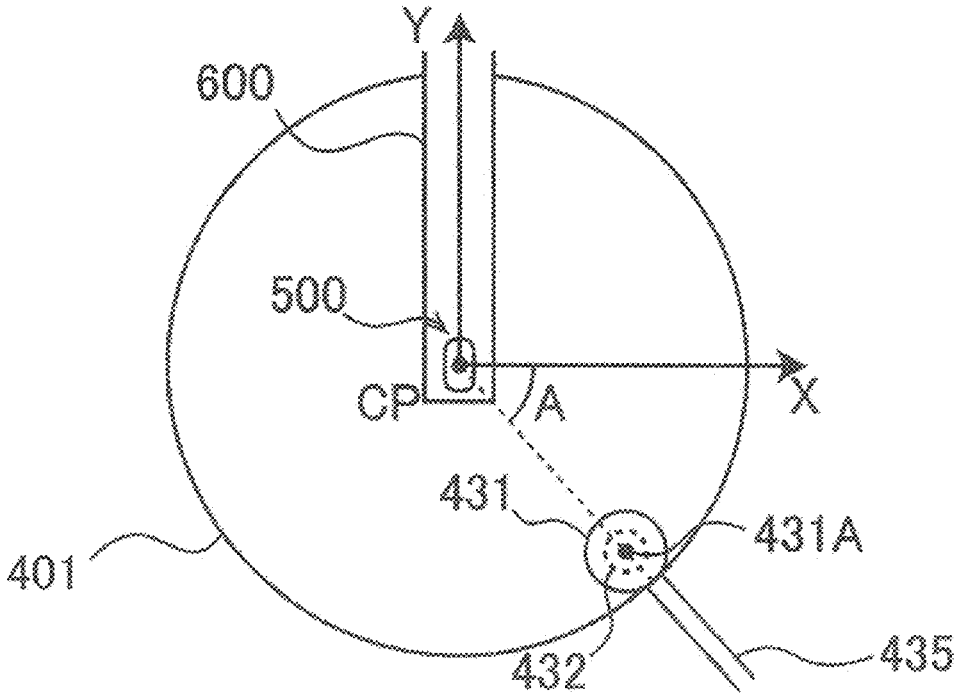
FIG. 15 is a plan view illustrating a positional relationship among the fluid jet nozzle, a holding arm, and the stage, according to one embodiment.

FIG. 15 is a plan view illustrating a positional relationship among the fluid jet nozzle 431, a holding arm 600, and the stage 401. A point at which the axis 401A of the stage 401 intersects the surface of the stage 401 is defined as an origin CP of the stage 401. The XY coordinate system illustrated in FIG. 15 is an imaginary coordinate system defined on the surface of the stage 401, and has the origin CP. The X-axis of the XY coordinate system is a horizontal line which passes through the origin CP and extends in an X direction of the partial polisher 1000, and the Y-axis of the XY coordinate system is a horizontal line which passes through the origin CP and extends vertically to the X-axis. The X-axis direction, i.e., the X direction of the partial polisher 1000 is a direction of the movement of a polishing head 500.

An angle A is an angle formed between a line extending from the origin CP and being perpendicular to the center line 431A of the fluid jet nozzle 431 and the X-axis. The angle A is measured in advance, and is stored in the controller 900. The holding arm 600 is disposed along the Y-axis. The polishing head 500 is disposed on the axis 401A and above the origin CP.

After the polishing head 500 and the fluid jet nozzle 431 are retracted outside of the stage 401, the transporter, which is not illustrated, places the substrate Wf on the top ends of the six positioning pins 402 (see FIG. 1). Then, the six positioning pins 402 are lowered to the above-described middle stage (FIG. 5B), and the substrate Wf is placed on the stage 401. As described above, the substrate Wf is positioned by the six positioning pins 402, so that the center O of the substrate Wf coincides with the origin CP of the stage 401. Then, the substrate Wf is fixed onto the stage 401 by means of vacuum chucking or the like.

After the substrate Wf is fixed onto the stage 401, the six positioning pins 402 are lowered to the above-described lower stage (FIG. 5C). Then, the fluid jet nozzle 431 is moved to a position illustrated in FIG. 15. The stage 401 is then rotated to a rotary origin of the stage 401 by the rotational drive mechanism 410 (see FIG. 1). The rotary origin of the stage 401 refers to a reference point of the angle of rotation of the stage 401.

Next, the rotational drive mechanism 410 rotates the stage 401 for a predetermined number of times in a predetermined direction. The controller 900 activates the detection section 408 at the same time when the stage 401 is rotated. The detection section 408 detects a position of the cut 450 by using the above-described method of detecting the cut. That is, the fluid jet nozzle 431 jets out the fluid to the peripheral edge portion of the substrate Wf while rotating the substrate Wf and the stage 401, and the position detector 440 detects a position of the cut 450 based on change in the fluid physical quantity (a pressure or a flow rate). The position detector 440 transmits a signal indicating the detected position of the cut 450 to the controller 900. When the substrate Wf is rotated for the predetermined number of times, the rotational drive mechanism 410 stops rotating the stage 401, and returns the stage 401 to the rotary origin thereof. The detection section 408 stops jetting out of the fluid from the fluid jet nozzle 431.

The stage 401 of the partial polisher 1000 includes the rotational drive mechanism 410, and is configured to be rotatable around the rotation axis 401A. The term "rotation" means continuous motion in a fixed direction, and motion in an arbitrary direction over a predetermined angular range of less than a single rotation. Note that, as another embodiment, the stage 401 may include a movement mechanism that imparts linear motion to the held substrate Wf.

Figure 7:
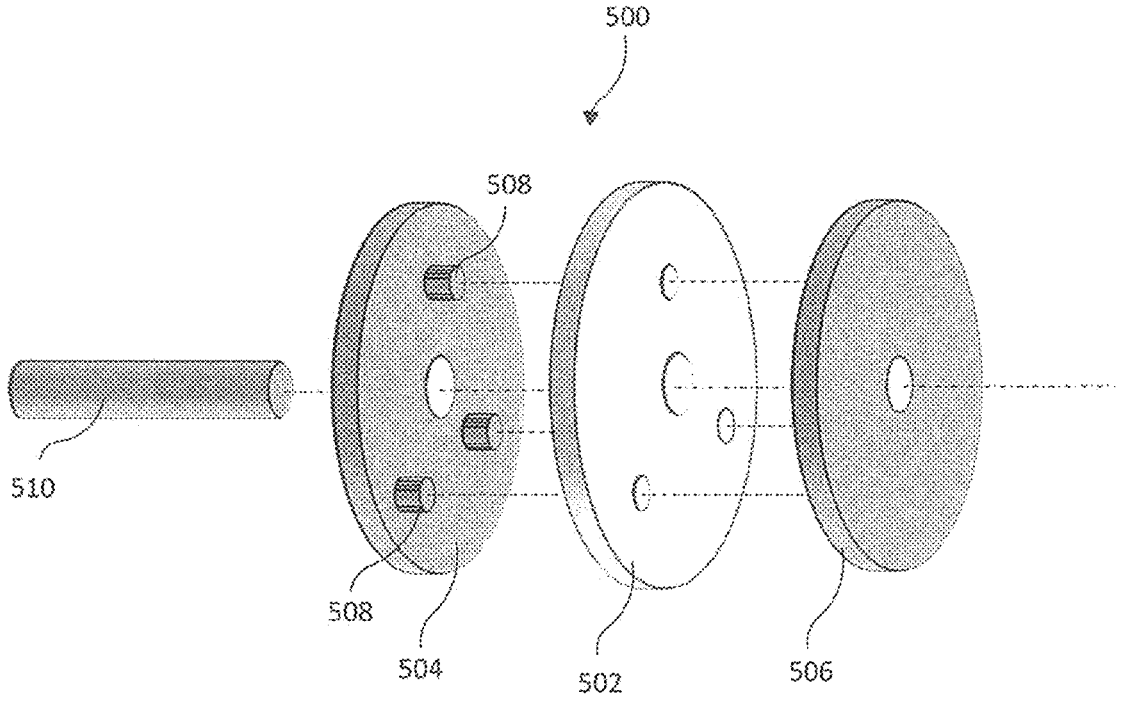
FIG. 7 is a schematic view illustrating a mechanism that allows a polishing head to hold a polishing pad, according to one embodiment.

The partial polisher 1000 illustrated in FIG. 1 includes the polishing head 500. The polishing head 500 holds the polishing pad 502. FIG. 7 is a schematic view illustrating the mechanism that allows the polishing head 500 to hold the polishing pad 502. The polishing head 500 includes a first holding member 504 and a second holding member 506, as illustrated in FIG. 7. The polishing pad 502 is held between the first holding member 504 and the second holding member 506. The first holding member 504, the polishing pad 502, and the second holding member 506 each have a disc-like shape, as illustrated in FIG. 7. The diameter of each of the first holding member 504 and the second holding member 506 is smaller than the diameter of the polishing pad 502. Therefore, in the state in which the polishing pad 502 is held by the first holding member 504 and the second holding member 506, the polishing pad 502 is exposed beyond the edges of the first holding member 504 and the second holding member 506. The first holding member 504, the polishing pad 502, and the second holding member 506 each have an opening at the center thereof, and a rotary shaft 510 is inserted into the openings. One or more alignment pins 508, which protrude toward the polishing pad 502, are provided on a surface of the first holding member 504 facing the polishing pad 502. On the other hand, through holes are provided in the positions on the polishing pad 502 that correspond to the alignment pins 508, and recesses that receive the alignment pins 508 are formed in a surface of the second holding member 506 facing the polishing pad 502. Therefore, when the rotary shaft 510 rotates the first holding member 504 and the second holding member 506, the holding members 504 and 506 can be rotated integrally with the polishing pad 502 with no slip thereof.

In the embodiment illustrated in FIG. 1, the polishing head 500 holds the polishing pad 502 in such a way that the side surface of the disc-like shape of the polishing pad 502 faces the substrate Wf. Note that the polishing pad 502 does not necessarily have a disc-like shape, and the polishing pad 502 having an arbitrary shape smaller in size than the substrate Wf can be used. The partial polisher 1000 illustrated in FIG. 1 includes the holding arm 600, which holds the polishing head 500. The holding arm 600 includes a first drive mechanism for imparting motion to the polishing pad 502 in a first motion direction with respect to the substrate Wf. The motion in the "first motion direction" used herein is motion of the polishing pad 502 for polishing the substrate Wf and is a rotary motion of the polishing pad 502 in the partial polisher 1000 in FIG. 1. The first drive mechanism can therefore be formed, for example, of a typical motor. In the portion where the polishing pad 502 is in contact with the substrate Wf, since the polishing pad 502 moves in parallel to the surface of the substrate Wf (a direction of tangent to the polishing pad 502, the x direction in FIG. 1), the "first motion direction," which is actually the direction of rotary motion of the polishing pad 502, can be considered as the direction of a fixed straight line.

In the partial polisher 1000 according to the embodiment illustrated in FIG. 1, the area where the polishing pad 502 is in contact with the substrate Wf can be reduced, and only part of the surface of the substrate Wf can be polished. Note that the region where the polishing pad 502 is in contact with the substrate Wf is determined by the diameter and thickness of the polishing pad 502. As an example, any value of the diameter c of the polishing pad 502 ranging from about 50 to 300 mm and any value of the thickness of the polishing pad 502 ranging from about 1 to 10 mm may be used in combination.

As one embodiment, the first drive mechanism can change the rotational speed of the polishing pad 502 during polishing. Changing the rotational speed allows adjustment of the polishing rate. Therefore, even in a case where a large polishing amount is required in a processed region of the substrate Wf, the polishing can be efficiently performed. Furthermore, for example, even in a case where the polishing pad 502 wears by a large amount during polishing and the diameter of the polishing pad 502 therefore changes, the adjustment of the rotational speed allows the polishing rate to be maintained. Note that, in the embodiment illustrated in FIG. 1, the first drive mechanism imparts rotary motion to the disc-shaped polishing pad 502, but in another embodiment, the polishing pad 502 can have another shape, and the first drive mechanism can be configured to impart linear motion to the polishing pad 502. Note that the linear motion includes a linear reciprocating motion.

The partial polisher 1000 illustrated in FIG. 1 includes a vertical drive mechanism 602 for moving the holding arm 600 in the direction perpendicular to the surface of the substrate Wf (the z direction in FIG. 1). The vertical drive mechanism 602 can move the polishing head 500 and the polishing pad 502 along with the holding arm 600 in the direction perpendicular to the surface of the substrate Wf. The vertical drive mechanism 602 also functions as a pressing mechanism for pressing the polishing pad 502 against the substrate Wf when the substrate Wf is partially polished. In the embodiment illustrated in FIG. 1, the vertical drive mechanism 602 is a mechanism using a motor and a ball screw, but as another embodiment, the vertical drive mechanism 602 may be a drive mechanism using air pressure or liquid pressure or a drive mechanism using a spring. Furthermore, as one embodiment, a drive mechanism for coarse motion and a drive mechanism for fine motion different from each other may be used as the vertical drive mechanism 602 for the polishing head 500. For example, the drive mechanism for coarse motion can be a drive mechanism using a motor, and the drive mechanism for fine motion, which presses the polishing pad 502 against the substrate Wf, can be a drive mechanism using an air cylinder. In this case, adjusting the air pressure in the air cylinder while monitoring the pressing force exerted by the polishing pad 502 allows controlling the pressing force exerted by the polishing pad 502 on the substrate Wf. Conversely, an air cylinder may be used as the drive mechanism for coarse motion, and a motor may be used as the drive mechanism for fine motion. In this case, controlling the motor for fine motion while monitoring the torque provided by the motor allows controlling the pressing force exerted by the polishing pad 502 on the substrate Wf. A piezoelectric element may be used as another drive mechanism, and voltage applied to the piezoelectric element can be used to adjust the amount of movement. Note that in the case where the vertical drive mechanism 602 is separated into the drive mechanism for coarse motion and the drive mechanism for fine motion, the drive mechanism for fine motion may be provided in a position where the holding arm 600 holds the polishing pad 502, that is, the distal end of the arm 600 in the example in FIG. 1.

The partial polisher 1000 illustrated in FIG. 1 includes a lateral drive mechanism 620 for moving the holding arm 600 in the lateral direction (the y direction in FIG. 1). The lateral drive mechanism 620 can move the polishing head 500 and the polishing pad 502 along with the arm 600 in the lateral direction. Note that the lateral direction (the y direction) is a second motion direction perpendicular to the above-described first motion direction and parallel to the surface of the substrate. The partial polisher 1000 can therefore further homogenize the shapes of the processed marks on the substrate Wf by moving the polishing pad 502 in the first motion direction (the x direction) to polish the substrate Wf and causing the polishing pad 502 to move in the second motion direction (the y direction) perpendicular to the first motion direction at the same time. As described above, in the partial polisher 1000 illustrated in FIG. 1, in the region where the polishing pad 502 is in contact with the substrate Wf, the linear speed is constant. However, if the state in which the polishing pad 502 is in contact with the substrate is not uniform due to unevenness of the shape and material of the polishing pad 502, the shape of each processed mark on the substrate Wf varies, particularly, the polishing rate varies in the direction perpendicular to the first motion direction on the surface where the polishing pad 502 is in contact with the substrate Wf. However, causing the polishing pad 502 during polishing to move in the direction perpendicular to the first motion direction allows reduction in the polishing variation, whereby the shapes of the processed marks can be more homogenized. Note that, in the embodiment illustrated in FIG. 1, the vertical drive mechanism 602 is a mechanism using a motor and a ball screw. In the embodiment illustrated in FIG. 1, the lateral drive mechanism 620 is configured to move the holding arm 600 by moving the vertical drive mechanism 602 as a whole. Note that the second motion direction is not necessarily exactly perpendicular to the first motion direction, but may be a direction having a component perpendicular to the first motion direction. Also, in the latter case, the effect of homogenizing the shapes of the processed marks can be provided.

The partial polisher 1000 according to the embodiment illustrated in FIG. 1 includes a polishing liquid supply nozzle 702. The polishing liquid supply nozzle 702 is fluidly connected to a supply source (not illustrated), which supplies the polishing liquid, for example, slurry. In the partial polisher 1000 according to the embodiment illustrated in FIG. 1, the polishing liquid supply nozzle 702 is held by the holding arm 600. The polishing liquid can therefore be efficiently supplied only to a polished region on the substrate Wf through the polishing liquid supply nozzle 702.

The partial polisher 1000 according to the embodiment illustrated in FIG. 1 includes a cleaning mechanism 200 for cleaning the substrate Wf. In the embodiment illustrated in FIG. 1, the cleaning mechanism 200 includes a cleaning head 202, a cleaning member 204, a cleaning head holding arm 206, and a rinse nozzle 208. The cleaning member 204 is a member for cleaning the partially polished substrate Wf with the rotated cleaning member 204 being in contact with the substrate Wf. The cleaning member 204 can be formed of a PVA sponge as one embodiment. The cleaning member 204 can instead include a cleaning nozzle for achieving mega-sonic cleaning, high-pressure water cleaning, or two-fluid cleaning in place of or in addition to the PVA sponge. The cleaning member 204 is held by the cleaning head 202. The cleaning head 202 is held by the cleaning head holding arm 206. The cleaning head holding arm 206 includes a drive mechanism for rotating the cleaning head 202 and the cleaning member 204. The drive mechanism can be formed, for example, of a motor. The cleaning head holding arm 206 further includes a swing mechanism for swinging the cleaning head 202 and the cleaning member 204 in the plane of the substrate Wf. The cleaning mechanism 200 includes the rinse nozzle 208. The rinse nozzle 208 is connected to a cleaning liquid supply source, which is not illustrated. The cleaning liquid can, for example, be pure water or a chemical liquid. In the embodiment in FIG. 1, the rinse nozzle 208 may be attached to the cleaning head holding arm 206. The rinse nozzle 208 includes a swing mechanism for swinging the rinse nozzle in the plane of Wf with the rinse nozzle 208 held by the cleaning head holding arm 206.

The partial polisher 1000 according to the embodiment illustrated in FIG. 1 includes a conditioner 800 for conditioning the polishing pad 502. The conditioner 800 is disposed in a position outside the stage 401. The conditioner 800 includes a dressing stage 810 that holds a dresser 820. In the embodiment in FIG. 1, the dressing stage 810 is rotatable around a rotation axis 810A. In the partial polisher 1000 in FIG. 1, the polishing pad 502 can be conditioned by pressing the polishing pad 502 against the dresser 820 and rotating the polishing pad 502 and the dresser 820. Note that as another embodiment, the dressing stage 810 may be configured to move linearly (including reciprocating motion) instead of rotary motion. Note that in the partial polisher 1000 in FIG. 1, the conditioner 800 is primarily used to condition the polishing pad 502 after completion of partial polishing at a certain point on the substrate Wf but before partial polishing at the following point or on the following substrate. The dresser 820 can be formed, for example, as (1) a diamond dresser having a surface onto which diamond particles are fixed in an electrodeposition process, (2) a diamond dresser having a surface which comes into contact with the polishing pad and on which diamond abrasive grains are entirely or partially placed, (3) a brushed dresser having a surface which comes into contact with the polishing pad and on which resin brushes are entirely or partially placed, or (4) any of the dressers described above or an arbitrary combination thereof.

The partial polisher 1000 according to the embodiment illustrated in FIG. 1 includes a second conditioner 850. The second conditioner 850 is intended to condition the polishing pad 502 during polishing of the substrate Wf with the polishing pad 502. The second conditioner 850 can therefore be called an in-situ conditioner. The second conditioner 850 is held by the holding arm 600 in the vicinity of the polishing pad 502. The second conditioner 850 includes a movement mechanism for moving a conditioning member 852 in the direction in which the conditioning member 852 is pressed against the polishing pad 502. In the embodiment in FIG. 1, the conditioning member 852 is held in the vicinity of the polishing pad 502 but separate from the polishing pad 502 in the x direction and is configured to be movable by the movement mechanism in the x direction. The conditioning member 852 is configured to be capable of rotating or moving linearly by means of a drive mechanism which is not illustrated. Therefore, in the course of polishing of the substrate Wf with the polishing pad 502, the polishing pad 502 can be conditioned during the polishing of the substrate Wf by pressing the conditioning member 852 in rotary motion or any other motion against the polishing pad 502.

In the embodiment illustrated in FIG. 1, the partial polisher 1000 includes the controller 900. The variety of drive mechanisms of the partial polisher 1000 are connected to the controller 900, and the controller 900 can control the action of the partial polisher 1000. The controller includes a computation section that calculates a target polishing amount in a polished region of the substrate Wf. The controller 900 is configured to control the polisher in accordance with the target polishing amount calculated by the computation section. Note that the controller 900 can be configured by installing a predetermined program in a typical computer including a storage device, a CPU, an input/output mechanism, and other components.

In one embodiment, the partial polisher 1000 may include, although not shown in FIG. 1, a state detecting section 420 (see FIGS. 9A and 9B) for detecting the state of the polished surface of the substrate Wf. The state detecting section 420 can be a Wet-ITM (in-line thickness monitor) by way of example. The Wet-ITM can detect (measure) the distribution of the thickness of a film formed on the substrate Wf (or distribution of information on film thickness) by moving a noncontact detection head, which is present above the substrate Wf, across the entire surface of the substrate Wf. As the state detecting section 420, a detector based on an arbitrary method other than the Wet-ITM can instead be used. For example, as a usable detection method, a noncontact detection method, such as a known eddy-current type or optical type, can be employed. Still instead, a contact-type detection method may be employed. As the contact-type detection method, for example, a detection head including a probe through which current can flow is prepared, and the surface of the substrate Wf is scanned with the probe which is in contact with the substrate Wf and through which current is caused to flow. Electrical resistance detection that allows detection of a film resistance distribution can thus be employed. As another contact detection method, a step detection method can also be employed. In the step detection method, the surface of the substrate Wf is scanned with a probe that is in contact with the surface of the substrate Wf, and the upward and downward motion of the probe is monitored to detect the distribution of irregularities across the surface. In each of the contact-type and noncontact-type detection methods, a detected output is the film thickness or a signal corresponding to the film thickness. In the optical detection, the amount of light projected onto the surface of the substrate Wf and reflected off the surface may be detected. In addition to this, a film thickness difference may be identified based on a difference in color tone of the surface of the substrate Wf. To detect the thickness of a film on the substrate Wf, it is desirable to detect the film thickness with the substrate Wf rotated and the detector swung in the radial direction of the substrate Wf. As a result, information on the film thickness across the entire surface of the substrate Wf and information on a step and other surface states can be obtained. Furthermore, use of the position of a notch or an orientation flat detected with the detection section 408 as a reference allows data on the film thickness and other factors to be related not only to the radial position but to the circumferential position, whereby a distribution of the film thicknesses and steps on the substrate Wf or signals relating thereto can be obtained. Furthermore, when partial polishing is performed, the actions of the stage 401 and the holding arm 600 can be controlled based on the positional data.

The above-described state detecting section 420 is connected to the controller 900, and a signal detected by the state detecting section 420 is processed by the controller 900. The controller 900 for the detector of the state detecting section 420 may use the same hardware as that used by the controller 900 that controls the actions of the stage 401, the polishing head 500, and the holding arm 600 or may use another piece of hardware. In the case where the controller 900 that controls the actions of the stage 401, the polishing head 500, and the holding arm 600 and the controller 900 for the detector use different pieces of hardware, hardware resources used in the polishing of the substrate Wf can be different from hardware resources used in the detection of the state of the surface of the substrate Wf and the subsequent signal processing, whereby the processing can be performed at high speed as a whole.

The timing when the state detecting section 420 performs the detection can be a timing before polishing of the substrate Wf, during the polishing, and/or after the polishing. In a case where the state detecting section 420 is independently incorporated, the detecting operation before the polishing, after the polishing, and even during the polishing but between adjacent polishing actions does not interfere with the action of the holding arm 600. It is, however, noted that when the thickness of a film on the substrate Wf is detected during the processing of the substrate Wf and concurrently with the processing performed by the polishing head 500, the state detecting section 420 performs the scanning in accordance with the action of the holding arm 600 to minimize a temporal delay of the thickness of a film on the substrate Wf being processed or a signal relating to the film thickness. In the present embodiment, the state detecting section 420 is incorporated in the partial polisher 1000 to detect the state of the surface of the substrate Wf. Instead, in a case where the polishing performed by the partial polisher 1000 takes time, for example, the detecting section may be disposed as a detection unit external to the partial polisher 1000 from the viewpoint of productivity. For example, as for ITM, Wet-ITM is effective in measurement during the processing, whereas in the acquisition of the film thickness or a signal corresponding thereto before or after the processing, the ITM is not necessarily required to be incorporated in the partial polisher 1000. The ITM may be disposed in a position outside the partial polisher module, and the measurement may be performed when the substrate Wf is placed in or removed from the partial polisher 1000. Furthermore, the polishing end point in each polished region of the substrate Wf may be determined based on the film thickness or signals relating to the film thickness, irregularities, and height acquired by the state detecting section 420.

Figure 8A:
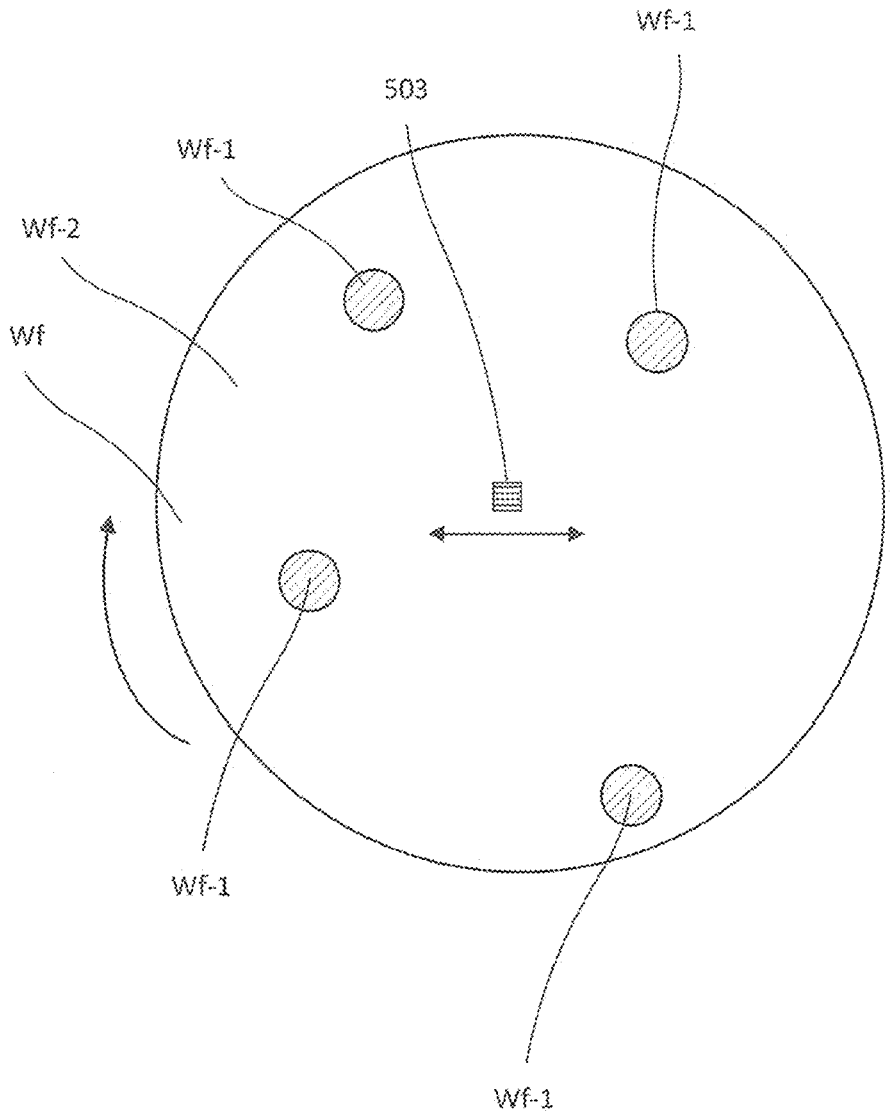
FIG. 8A is a schematic view for describing an example of control of the polishing using the partial polisher according to one embodiment.

FIG. 8A is a schematic view for describing an example of control of the polishing using the partial polisher 1000 according to one embodiment. FIG. 8A is a schematic view of the substrate Wf viewed from above and illustrates an example in which portions Wf-1, where the film thickness is greater than the film thickness in the other portion Wf-2, are randomly formed. It is assumed in FIG. 8A that the polishing pad 502 has a roughly rectangular unit processed mark 503. The size of the unit processed mark 503 corresponds to the area where the polishing pad 502 is in contact with the substrate Wf. As illustrated in FIG. 8A, it is assumed that the portions Wf-1, where the film thickness is greater than the film thickness in the other portion Wf-2, are randomly formed on the processed surface of the substrate Wf. In this case, the controller 900 can cause the drive mechanism that drives the stage 401 to cause the substrate Wf to rotate angularly so that the polishing amount in each of the portions Wf-1, where the film on the substrate Wf is thicker, is greater than the polishing amount in the other portion Wf-2. For example, the controller 900 can grasp the position of each of the portions Wf-1, where the film on the substrate Wf is thicker, with respect to a notch, an orientation flat, or a laser marker on the substrate Wf and use the drive mechanism that drives the stage 401 to cause the substrate Wf to rotate angularly in such a way that the position falls within the range over which the polishing head 500 swings. Specifically, the partial polisher 1000 illustrated in FIG. 1 includes the detection section 408 that detects at least one of the notch, the orientation flat, and the laser marker on the substrate Wf, moves the polishing head 500 in the radial direction to a polishing position calculated based on the detected notch, orientation flat, or laser marker and the surface state distribution of the substrate Wf detected by the state detecting section 420, and rotates the substrate Wf on the stage 401 by an arbitrary predetermined angle. Note that the controller 900 only needs to polish Wf-1 in a case where the Wf-2 region has a desired film thickness. In a case where both Wf-1 and Wf-2 are polished to achieve a desired film thickness, the polishing head 500 can be controlled such that when each of the portions Wf-1, where the film on the substrate Wf is thicker, falls within the range over which the polishing head 500 swings, the number of revolutions of the polishing head 500 is greater than the number of revolutions in the other portion Wf-2. Furthermore, the controller 900 can control the polishing head 500 in such a way that when each of the portions Wf-1, where the film on the substrate Wf is thicker, falls within the range over which the polishing head 500 swings, the pressing force exerted by the polishing pad 502 is greater than the force in the other portion Wf-2. Furthermore, the controller 900 can control the swing speed of the holding arm 600 in such a way that the polishing period (period for which the polishing pad 502 stays) for which each of the portions Wf-1, where the film on the substrate Wf is thicker, falls within the range over which the polishing head 500 swings is longer than the polishing period in the other portion Wf-2. Furthermore, the controller 900 can perform control so as to rotate the polishing head 500 with the stage 401 being stationary in the position where the polishing pad 502 is above each of the portions Wf-1, where the film on the substrate Wf is thicker, to polish only the portion Wf-1, where the film on the substrate Wf is thicker. As a result, the partial polisher 1000 can polish the polished surface into a flat surface by using the controller 900.

Figure 8B:
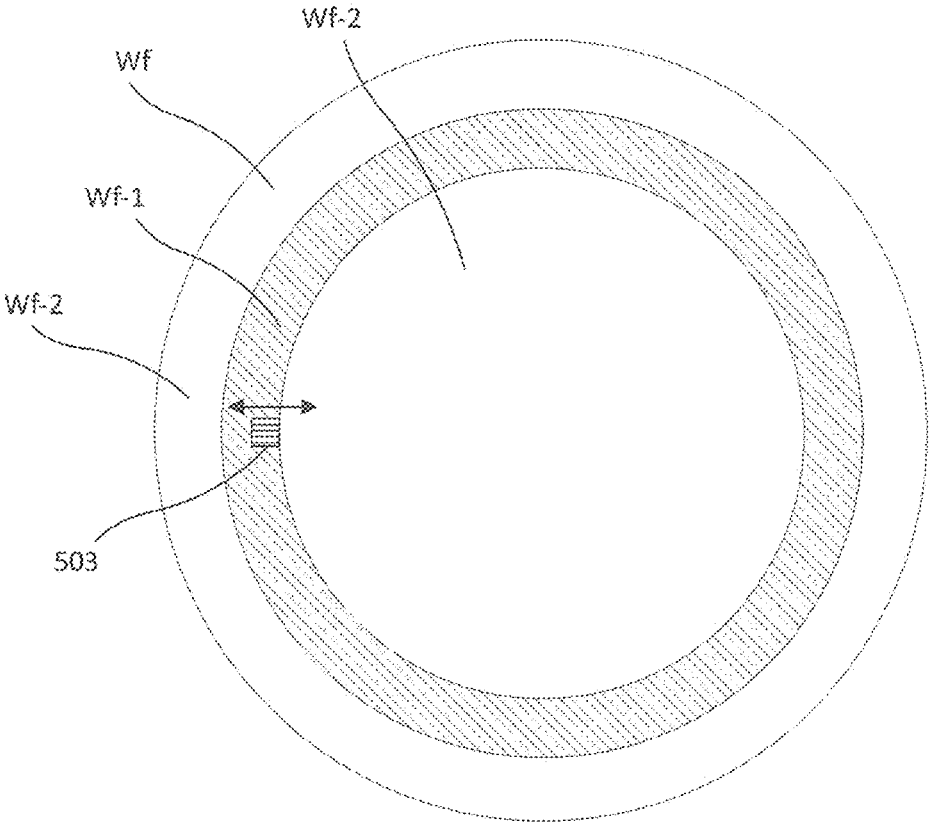
FIG. 8B is a schematic view for describing an example of control of the polishing using the partial polisher according to one embodiment.

FIG. 8B is a schematic view for describing an example of control of the polishing using the partial polisher 1000. FIG. 8B is a schematic view of the substrate Wf viewed from above and illustrates an example in which a portion Wf-1, where the film thickness is greater than the film thickness in the other portions Wf-2, is concentrically formed. It is assumed in FIG. 8B that the polishing pad 502 has the roughly rectangular unit processed mark 503. The size of the unit processed mark 503 corresponds to the area where the polishing pad 502 is in contact with the substrate Wf. As illustrated in FIG. 8B, it is assumed that the portion Wf-1, where the film thickness is greater than the film thickness in the other portions Wf-2, is concentrically formed on the processed surface of the substrate Wf. In this case, the controller 900 performs polishing by rotating the stage 401 and moving the holding arm 600 in the radial direction of the substrate Wf at the same time. Note that in a case where the Wf-2 regions have a desired film thickness, only the Wf-1 region of the substrate Wf is polished. In a case where both Wf-1 and Wf-2 are polished to achieve a desired film thickness, the number of revolutions of the polishing head 500 can be controlled to be greater in Wf-1 than in Wf-2. Furthermore, the controller 900 can control the polishing head 500 in such a way that the pressing force exerted by the polishing pad 502 is greater in Wf-1 than in Wf-2. Furthermore, the controller 900 can control the swing speed of the holding arm 600 in such a way that the polishing period (period for which the polishing pad 502 stays) in Wf-1 is longer than the polishing period in Wf-2. As a result, the controller 900 allows the polished surface of the substrate Wf to be polished into a flat surface.

Figure 9A:
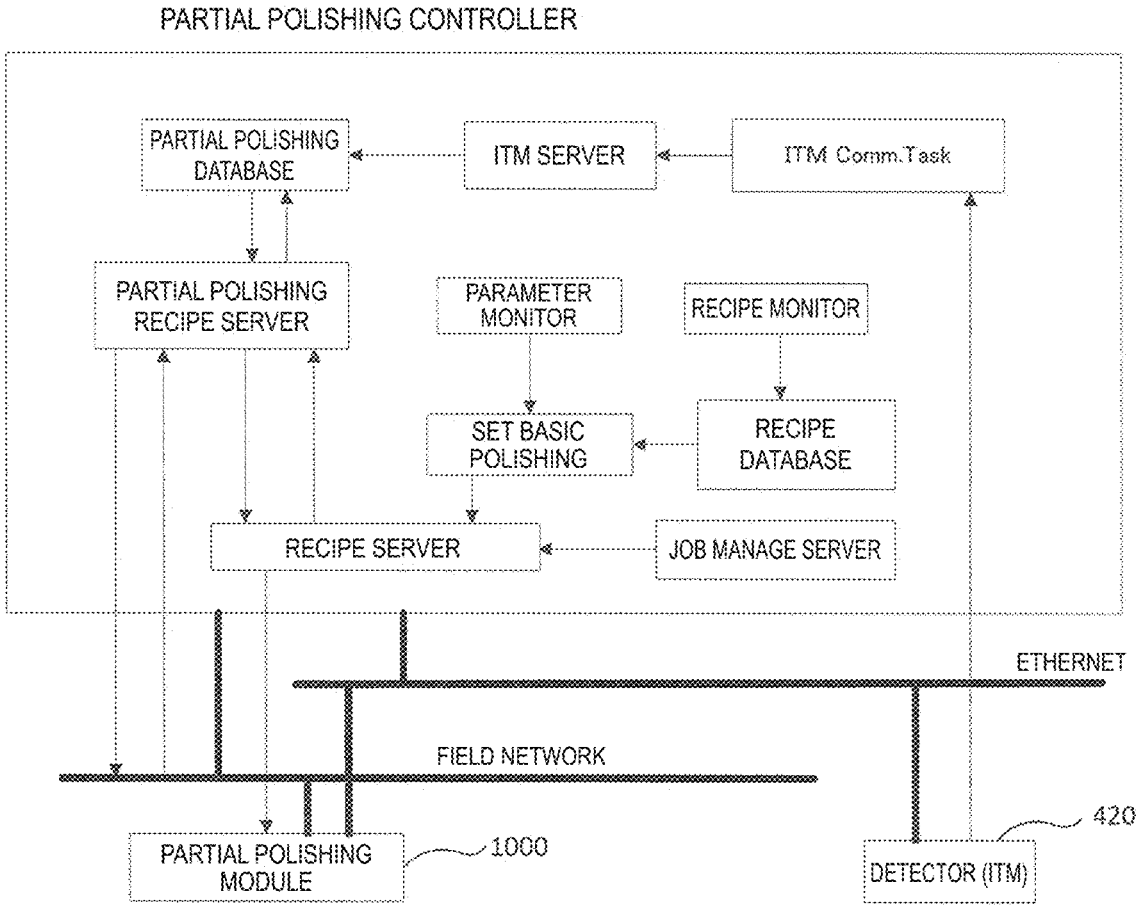
FIG. 9A illustrates an example of a control circuit for processing information on the thickness of a film on the substrate Wf and irregularities and height thereof according to one embodiment.

FIG. 9A illustrates an example of a control circuit for processing information on the thickness of a film on the substrate Wf and irregularities and height thereof according to one embodiment. First, a partial polishing controller combines a polishing process recipe set via an HMI (human machine interface) with parameters to determine a basic partial polishing process recipe. In this process, the partial polishing process recipe and the parameters may be downloaded from a HOST to the partial polisher 1000. A recipe server then combines the basic partial polishing process recipe with polishing process information on a process job to produce a basic partial polishing process recipe for each substrate Wf to be processed. The partial polishing recipe server combines the partial polishing process recipe for each substrate Wf to be processed, substrate surface shape data stored in a partial polishing database, and, further, data on the substrate surface shape and other factors relating to similar substrates and obtained after past partial polishing and polishing rate data on each parameter in a polishing condition acquired in advance with one another to produce a partial polishing process recipe on a substrate basis. At this point, the substrate surface shape data stored in the partial polishing database may be data on the substrate Wf measured by the partial polisher 1000 or may be data downloaded in advance from the HOST to the partial polisher 1000. The partial polishing recipe server transmits the partial polishing process recipe via the recipe server or directly to the partial polisher 1000. The partial polisher 1000 partially polishes the substrate Wf in accordance with the received partial polishing process recipe.

Figure 9B:
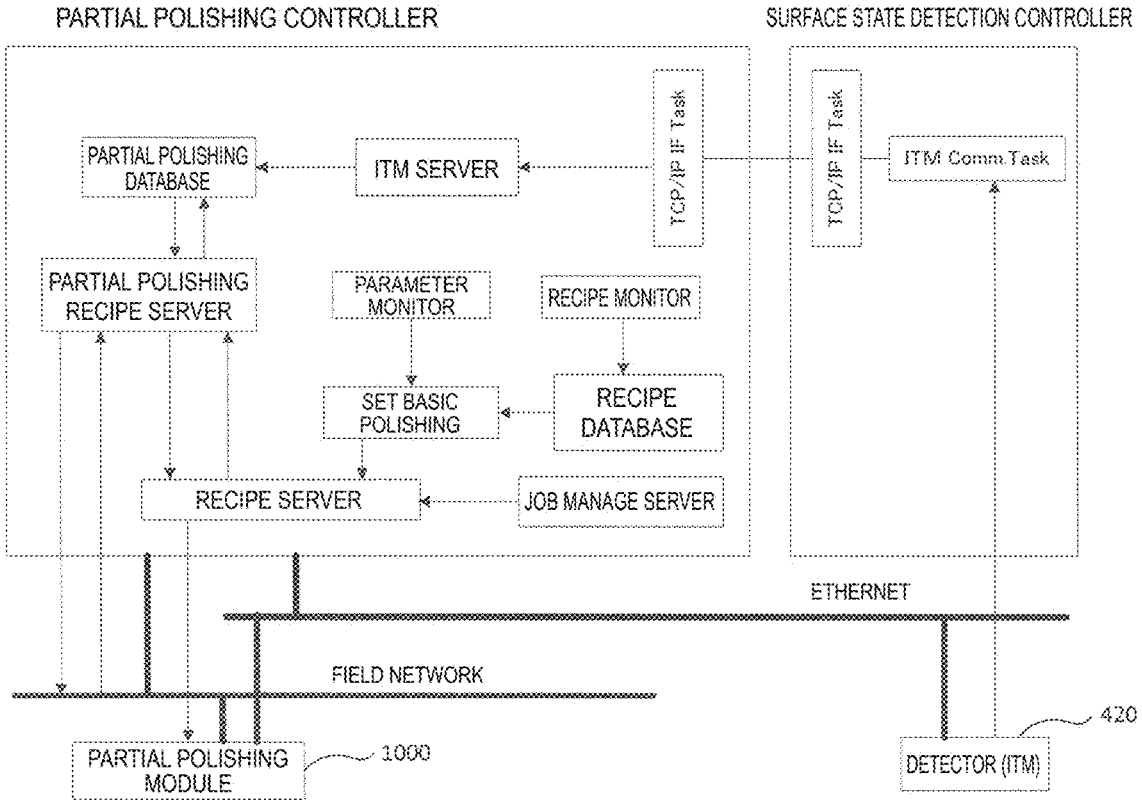
FIG. 9B illustrates a circuit diagram illustrating a substrate surface state detecting section separated from a partial polishing controller illustrated in FIG. 9A.

FIG. 9B illustrates a circuit diagram illustrating the substrate surface state detecting section 420 separated from the partial polishing controller illustrated in FIG. 9A. It can be expected by separating the substrate surface state detection controller, which handles a large amount of data, from the partial polishing controller that the data processing load on the partial polishing controller is reduced and the period for creating the process job and the processing period required for the generation of a partial polishing process recipe can be shortened, whereby the overall throughput of the partial polishing module can be improved.

In each of the partial polishers 1000 according to the embodiments described above, the first drive mechanism allows the polishing pad 502 for polishing the substrate Wf to move in the first motion direction. The first motion direction is the direction in which the polishing pad 502 moves in the region where the polishing pad 502 is in contact with the substrate Wf. For example, in the case where the polishing pad 502 has a disc-like shape and rotates, the first motion direction of the polishing pad 502 is the direction of a tangent to the polishing pad 502 in the region where the polishing pad 502 is in contact with the substrate Wf. Furthermore, in each of the partial polishers 1000 according to the embodiments described above, the lateral drive mechanism 620 allows the polishing pad 502 to move in the second motion direction having a component perpendicular to the first motion direction and parallel to the substrate Wf. Causing the polishing pad 502 to move in the second motion direction during the polishing of the substrate Wf as described above allows a further uniform shape of processed marks on the substrate Wf. The polishing pad 502 can be moved by an arbitrary amount in the second motion direction during the polishing, and the amount of movement in the second motion direction can be determined from a variety of points of view.

Figure 10:
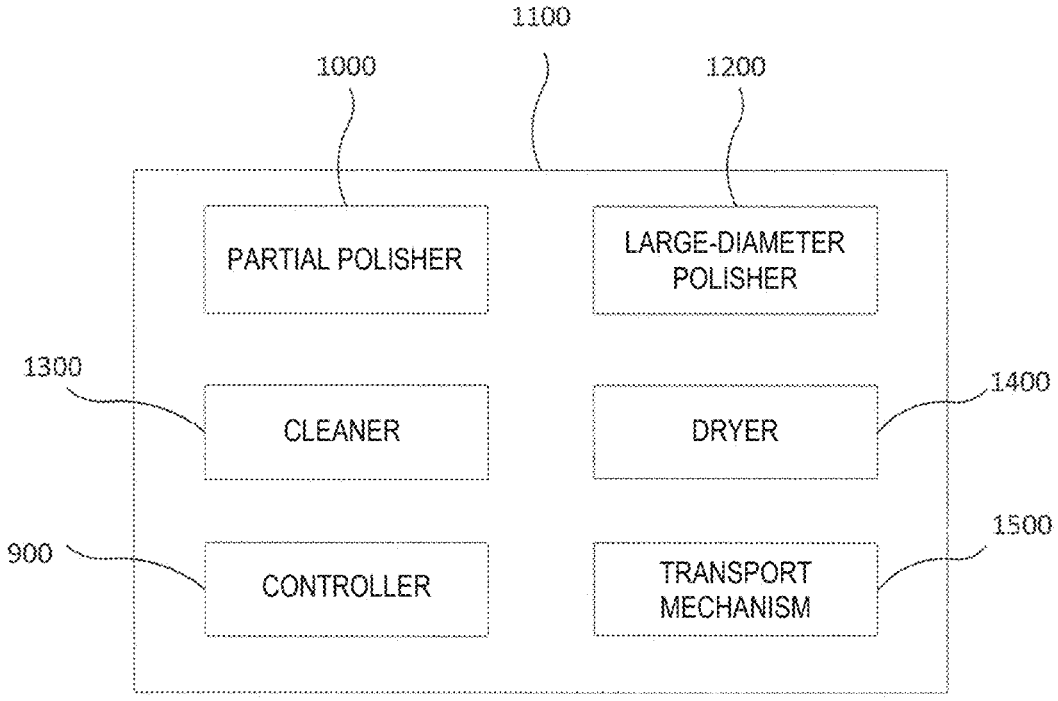
FIG. 10 is a schematic view illustrating a substrate processing system including the partial polisher according to one embodiment.

FIG. 10 is a schematic view illustrating a substrate processing system 1100 according to one embodiment, which incorporates the partial polisher 1000. The substrate processing system 1100 includes the partial polisher 1000, a large-diameter polisher 1200, a cleaner 1300, a dryer 1400, the controller 900, and a transport mechanism 1500, as illustrated in FIG. 10. The partial polisher 1000 in the substrate processing system 1100 can be the partial polisher 1000 having any of the features described above. The large-diameter polisher 1200 is a polisher that polishes a substrate by using a polishing pad having an area greater than the area of the substrate Wf, which is a target to be polished. The large-diameter polisher 1200 can be formed of a known CMP apparatus. The cleaner 1300, the dryer 1400, and the transport mechanism 1500 can also be each an arbitrary known apparatus. The controller 900 can be configured to control the entire action of the substrate processing system 1100 as well as the action of the partial polisher 1000 described above. In the embodiment illustrated in FIG. 10, the partial polisher 1000 and the large-diameter polisher 1200 are incorporated in one substrate processing system 1100. Therefore, combining the partial polishing performed by the partial polisher 1000, overall polishing of the substrate Wf performed by the large-diameter polisher 1200, and detection of the state of the surface of the substrate Wf performed by the state detecting section 420 allows a variety of types of polishing. Note that in the partial polishing performed by the partial polisher 1000, only part of the surface of the substrate Wf instead of the entire surface thereof can be polished, or in the polishing of the entire surface of the substrate Wf performed by the partial polisher 1000, the polishing condition can be changed in part of the surface of the substrate Wf and the polishing can be performed in accordance with the changed polishing condition.

A partial polishing method carried out by the substrate processing system 1100 will be described. First, the state of the surface of the substrate Wf, which is the polishing target object, is detected. The surface state is, for example, information on the thickness of a film formed on the substrate Wf and irregularities of the surface (such as position, size, and height) and can be detected by the state detecting section 420 described above. A polishing recipe is then created in accordance with the detected state of the surface of the substrate Wf. The polishing recipe is formed of a plurality of process steps. Parameters in the steps, for example, in the partial polisher 1000 include the processing period, the contact pressure or load exerted by the polishing pad 502 on the substrate Wf and the dresser 820 disposed on the dressing stage 810, the number of revolutions of the polishing pad 502 and the substrate Wf, the movement pattern and moving speed of the polishing head 500, the selection and flow rate of the polishing pad processing liquid, the number of revolutions of the dressing stage 810, and the polishing end point detection condition. Furthermore, in the partial polishing, it is necessary to determine the action of the polishing head 500 on the substrate Wf based on the information on the film thickness and irregularities on the substrate Wf acquired by the state detecting section 420 described above. For example, as for the period for which the polishing head 500 stays in each polished region of the substrate Wf, examples of the parameters involved in the determination described above may include target values corresponding to a desired film thickness and a desired state of the irregularities and a polishing rate in the polishing condition described above. The polishing rate, which varies depending on the polishing condition, may be stored as a database in the controller 900 and may be automatically calculated when a polishing condition is set. In this case, a polishing rate for each basic parameter may be acquired in advance and stored as a database. The period for which the polishing head 500 stays on the substrate Wf can be calculated from the information on the parameters and the acquired film thickness and irregularities on the substrate Wf. Furthermore, as will be described later, since the order of the pre-measurement, partial polishing, overall polishing, and cleaning varies depending on the state of the substrate Wf and the processing liquid to be used, the transport order of the components described above may be set. Furthermore, a condition under which data on the film thickness and irregularities on the substrate Wf is acquired may be set. In a case where the state of the processed Wf does not reach an acceptable level, as will be described later, the polishing is required to be performed again. A processing condition (such as number of repetitions of re-polishing) in this case may be set. Partial polishing and overall polishing are then performed in accordance with the created polishing recipe. Note that in the present example and other examples described later, the substrate Wf can be cleaned at an arbitrary timing. For example, in a case where the processing liquid used in the partial polishing differs from the processing liquid used in the overall polishing, and contamination of the processing liquid in the partial polishing is not negligible in the overall polishing, the substrate Wf may be cleaned after each of the partial polishing and the overall polishing to prevent the contamination. Conversely, in a case where the same processing liquid is used or in a case where the contamination of the processing liquid is negligible, the substrate Wf may be cleaned after both the partial polishing and the overall polishing are performed.

In each of the embodiments described above, an example is described in which the substrate holding device 400 is used for the partial polisher 1000, but the substrate holding device 400 can be used for a substrate processing apparatuses other than the partial polisher 1000. For example, the substrate holding device 400 can be used for a polisher that polishes the peripheral edge portion of the substrate.

The embodiments of the present invention have been described based on some examples. The inventive embodiments described above are intended to allow easy understanding of the present invention and are not intended to limit the present invention. The present invention can be changed and improved to the extent that the changes or improvements do not depart from the substance of the present invention and of course encompasses equivalents of the present invention. The components described in the claims and the specification can be arbitrarily combined with one another or any of the components can be omitted to the extent that at least part of the object described above is achieved or at least part of the effects is provided.

REFERENCE SIGNS LIST

400 . . . Substrate holding device
401 . . . Stage
401*a* . . . Stage main body
401A . . . Rotation axis
401*b* . . . First engagement portion

402 . . . Positioning pin
402*a* . . . Guide portion
402*b* . . . Substrate support portion
402*c* . . . Arm portion
402*d* . . . Shaft portion
402*e* . . . Elastic member contact portion
402*f* . . . Stopper contact portion
402*z* . . . Rotation axis
403 . . . Elastic member
404 . . . Pin stage
404*b* . . . First engagement portion
404*c* . . . Second engagement portion
405 . . . Base member
405*a* . . . Stopper member
405*b* . . . Elastic member
405*c* . . . Second engagement portion
406 . . . Pedestal
408 . . . Detection section
410 . . . Rotational drive mechanism
900 . . . Controller
1000 . . . Partial polisher
Wf . . . Substrate

What is claimed is:

1. A substrate holding device for holding a substrate, comprising:

a substrate stage for supporting the substrate;

a stage drive mechanism for causing the substrate stage to rotate;

a positioning pin for positioning the substrate on the substrate stage;

first urging members each urging the positioning pin; and a stopper member capable of applying a force against the first urging member to the positioning pin, wherein the positioning pin is configured to rotate together with the substrate stage by the stage drive mechanism, and the positioning pin rotating together with the substrate stage allows the substrate to be positioned on the substrate stage.

2. The substrate holding device according to claim 1, further comprising:

a base member whose position is fixed, wherein the stopper member is fixed to the base member.

3. The substrate holding device according to claim 1, further comprising:

a positioning pin stage, wherein the positioning pin is fixed to the positioning pin stage, and the positioning pin stage is configured to be capable of engaging with and disengaging from the substrate stage.

4. The substrate holding device according to claim 3, wherein the positioning pin stage is configured to be movable between (1) an engagement position at which the positioning pin stage engages with the substrate stage and (2) a disengagement position at which the positioning pin stage disengages from the substrate stage, the engagement position and the disengagement position being separate from each other in a direction perpendicular to a top surface of the substrate stage.

5. The substrate holding device according to claim 4, wherein the positioning pin includes a substrate support portion, and the positioning pin is configured to be capable of supporting the substrate by the substrate support portion when the positioning pin stage is at the disengagement position.

6. The substrate holding device according to claim 1, further comprising:

a base member whose position is fixed, wherein the stopper member is fixed to the base member;

a positioning pin stage, wherein the positioning pin is fixed to the positioning pin stage, and the positioning pin stage is configured to be capable of engaging with and disengaging from the substrate stage;

the positioning pin stage is connected to the base member through a second urging member, and the second urging member is configured to urge the positioning pin stage in a direction opposite to a direction in which the positioning pin stage rotates together with the substrate stage.

7. The substrate holding device according to claim 1, wherein the positioning pin is urged by the first urging member in a central direction of the substrate.

8. The substrate holding device according to claim 1, wherein the number of the positioning pin is three or more.

9. The substrate holding device according to claim 8, wherein the number of the positioning pin is six or more.

10. The substrate holding device according to claim 1, wherein the substrate stage has a circular top surface for supporting a circular substrate.

11. The substrate holding device according to claim 10, wherein the stage drive mechanism has a motor for rotating the substrate stage, and the positioning pin is configured to position the substrate so that a center of the substrate coincides with a rotation center of the substrate stage.

12. A substrate processing apparatus, comprising:

the substrate holding device according to claim 1, wherein the substrate processing apparatus is configured to perform processing on a substrate held by the substrate holding device.

13. The substrate processing apparatus according to claim 12, comprising:

a partial polisher partially polishing the substrate held by the substrate holding device.

14. A substrate holding device for holding a substrate, comprising:

a substrate stage for supporting the substrate;

a stage drive mechanism for causing the substrate stage to move;

a positioning pin for positioning the substrate on the substrate stage;

first urging members each urging the positioning pin; and a stopper member capable of applying a force against the first urging member to the positioning pin, wherein the positioning pin is configured to move together with the substrate stage by the stage drive mechanism, and the positioning pin moving together with the substrate stage allows the substrate to be positioned on the substrate stage, the substrate holding device further comprises:

a base member whose position is fixed, wherein the stopper member is fixed to the base member;

a positioning pin stage, wherein the positioning pin is fixed to the positioning pin stage, and the positioning pin stage is configured to be capable of engaging with and disengaging from the substrate stage;

the positioning pin stage is connected to the base member through a second urging member, and the second urging member is configured to urge the positioning pin stage in a direction opposite to a direction in which the positioning pin stage moves together with the substrate stage.

* * * * *